US012644635B2

(12) United States Patent
Pagnozzi et al.

(10) Patent No.: US 12,644,635 B2
(45) Date of Patent: Jun. 2, 2026

(54) VARIABLE CLIMATE ZONE COMPARTMENT

(71) Applicant: ELECTROLUX DO BRASIL S.A., Curitiba (BR)

(72) Inventors: Rodrigo Marge Pagnozzi, Curitiba (BR); Israel Mercer Neto, Curitiba (BR); Guilherme Rissatto Picanço, Curitiba (BR); Augusto Biscaia Da Silva, Curitiba (BR); Alexandre Sauer, Curitiba (BR); Alcione Colecha, Curitiba (BR); Aguilar Da Silva, Curitiba (BR)

(73) Assignee: Electrolux Do Brasil S.A., Curitiba (BR)

( * ) Notice: Subject to any disclaimer, the term of this patent is extended or adjusted under 35 U.S.C. 154(b) by 923 days.

(21) Appl. No.: 17/639,752

(22) PCT Filed: Sep. 4, 2019

(86) PCT No.: PCT/BR2019/050372

§ 371 (c)(1),
(2) Date: Mar. 2, 2022

(87) PCT Pub. No.: WO2021/042188

PCT Pub. Date: Mar. 11, 2021

(65) Prior Publication Data

US 2022/0341648 A1 Oct. 27, 2022

(51) Int. Cl.
*F25D 17/06* (2006.01)
*F25D 17/04* (2006.01)

(52) U.S. Cl.
CPC ..... *F25D 17/065* (2013.01); *F25D 17/045* (2013.01); *F25D 2317/063* (2013.01); *F25D 2317/067* (2013.01); *F25D 2400/02* (2013.01)

(58) Field of Classification Search
CPC ..... F25D 2400/02; F25D 2317/067; F25D 2317/063; F25D 17/045; F25D 17/065
See application file for complete search history.

(56) References Cited

U.S. PATENT DOCUMENTS 1,813,187 A * 7/1931 Moore ..... F25D 17/005 62/413
3,590,911 A 7/1971 Horvay
(Continued)

FOREIGN PATENT DOCUMENTS

JP 2001116421 A * 4/2001
JP 2009041883 A * 2/2009
(Continued)

OTHER PUBLICATIONS

Extended European Search Report for application No. 19944106.4 dated Mar. 31, 2023, 7 pages.
(Continued)

*Primary Examiner* — Devon Lane
(74) *Attorney, Agent, or Firm* — Chrisman Gallo Tochtrop LLC

(57) ABSTRACT

A refrigeration appliance including a compartment for storing food items. A partition divides the compartment into a first and a second compartments. The first compartment is disposed horizontally adjacent the second compartment and has a user-selectable target freezer temperature. An evaporator is disposed in the first compartment. An evaporator fan is disposed in the first compartment for conveying cooling air from the evaporator to the first and the second compartments. A temperature control module positioned in the second compartment. The temperature control module includes a body having front and rear surfaces. An air passage is formed in the body and extends between a side inlet opening of the body to at least one outlet opening on the front surface of the body. A heater assembly is disposed
(Continued)

between the front and the rear surfaces of the body for heating air in the air passage.

20 Claims, 22 Drawing Sheets

(56) References Cited

U.S. PATENT DOCUMENTS

| | | | | |
|---|---|---|---|---|
| 5,255,530 | A | 10/1993 | Janke | |
| 5,678,300 | A * | 10/1997 | Saur | F01P 7/167 29/613 |
| 7,926,298 | B2 | 4/2011 | Kuehl et al. | |
| 10,082,330 | B2 | 9/2018 | Chung et al. | |
| 10,274,242 | B2 * | 4/2019 | Besore | F25D 23/066 |
| 2009/0133432 | A1 | 5/2009 | Lee et al. | |
| 2010/0147003 | A1 | 6/2010 | Ueda et al. | |
| 2017/0363339 | A1 | 12/2017 | Malisi et al. | |
| 2018/0224185 | A1 | 8/2018 | Besore et al. | |
| 2018/0224188 | A1 | 8/2018 | Lee et al. | |
| 2018/0313593 | A1 | 11/2018 | Olvera et al. | |
| 2018/0335242 | A1 * | 11/2018 | Besore | F25B 41/24 |

FOREIGN PATENT DOCUMENTS

| | | | | |
|---|---|---|---|---|
| WO | 2009061076 | | 5/2009 | |
| WO | WO-2009061076 | A2 * | 5/2009 | D06F 29/00 |
| WO | 2010099101 | | 9/2010 | |
| WO | WO-2010099101 | A2 * | 9/2010 | F25B 29/00 |

OTHER PUBLICATIONS

International Search Report for PCT/BR2019/050372 dated May 22, 2020, 1 page.

Chinese Office action (English Translation) in related application No. 201980101427.1 dated Oct. 30, 2024, 18 pages.

* cited by examiner

VARIABLE CLIMATE ZONE COMPARTMENT

CROSS-REFERENCE TO RELATED APPLICATIONS

None

FIELD OF THE INVENTION

This application relates generally to a variable climate zone compartment for a refrigeration appliance, and more particularly, to a refrigeration appliance including a heater for heating and maintaining the variable climate zone at a predetermined temperature.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Some refrigerators include a variable climate zone (VCZ) compartment wherein a user may select the temperature of the VCZ compartment based on the food products that will be stored in the VCZ compartment. In instances where the temperature of the VCZ compartment must be increased, it often takes an extended amount of time for the temperature in the VCZ compartment to increase to the desired temperature.

The present invention provides a heater for use in a variable climate zone compartment of a refrigerator.

BRIEF SUMMARY OF THE INVENTION

In accordance with Aspect I, there is provided a refrigeration appliance that includes a compartment for storing food items in a refrigerated environment. A partition divides the compartment into a first compartment and a second compartment. The first compartment is disposed horizontally adjacent the second compartment. The first compartment has a user-selectable target freezer temperature. The second compartment has a user-selectable target variable climate zone temperature between a predetermined temperature below 0 degrees Centigrade and a predetermined temperature above 0 degrees Centigrade. An evaporator is disposed in the first compartment. An evaporator fan is disposed in the first compartment for conveying cooling air from the evaporator to the first compartment and the second compartment. A temperature control module is positioned in the second compartment. The temperature control module includes a body having a front surface and a rear surface. The rear surface faces a rear wall of the second compartment and the front surface faces an open end of the second compartment. An air passage is formed in the body extending between a side inlet opening of the body to at least one outlet opening on the front surface of the body. A heater assembly is disposed between the front surface and the rear surface of the body proximate the air passage wherein air in the air passage is heated by the heater assembly when the heater assembly is energized.

In Aspect II there is provided a partition that is a vertical mullion.

In Aspect II there is provided a heater assembly that includes an electrical coil.

In Aspect III there is provided a heater assembly that is overmolded into a body.

In in Aspect IV there is provided a body that includes a front portion and a rear portion and at least a portion of an air passage is defined between the rear portion and the front portion.

In Aspect V there is provided at least a portion of an air passage that is defined by a recess formed in at least one of a front portion and a rear portion of a body.

In Aspect VI there is provided a heater assembly that is embedded within at least one of a front portion and a rear portion of a body.

In Aspect VII there is provided an air passage that includes a second inlet opening extending through a front surface of the body.

In Aspect VIII there is provided a circulation fan that is positioned in an air passage for conveying air therealong.

In Aspect IX there is provided an air passage that defines a closed loop circulation path with a second compartment.

In Aspect X there is provided a fresh food compartment that is disposed above a compartment. The fresh food compartment storing food items in a refrigerated environment having a target temperature above zero degrees Centigrade.

In accordance with an Aspect XI, there is provided a refrigeration appliance that includes a compartment for storing food items in a refrigerated environment. A partition divides the compartment into a first compartment and a second compartment. The first compartment is disposed horizontally adjacent the second compartment. The first compartment has a user-selectable target freezer temperature. The second compartment has a user-selectable target variable climate zone temperature between a predetermined temperature below 0 degrees Centigrade and a predetermined temperature above 0 degrees Centigrade. The partition defines a through passage between the first compartment and the second compartment. An evaporator is disposed in the first compartment. An evaporator fan is disposed in the first compartment for conveying cooling air from the evaporator to the first compartment and the second compartment. A temperature control module is positioned in the second compartment. The temperature control module includes a body having a front surface and a rear surface, the rear surface facing a rear wall of the second compartment and the front surface facing an open end of the second compartment. An air passage is formed in the body and extends between a side inlet opening of the body and at least one outlet opening on the front surface of the body. The side inlet opening of the air passage is aligned with the through passage in the partition between the first compartment and the second compartment. A second inlet opening extends through the front surface of the body to the air passage. A damper assembly is positioned proximate the air passage. The damper assembly includes a frame assembly defining a damper air passage through the damper assembly fluidly communicating with the air passage formed in the partition. A door is rotatably attached to the frame assembly. The door is moveable between a first position and a second position. When the door is in the first position the door fluidly isolates the through passage in the partition from the first compartment while allowing the second inlet opening in the body to fluidly communicate with the air passage in the body. When the door is in the second position the door fluidly isolates the second inlet opening in the body from the air passage in the body while allowing the through passage in the partition to fluidly communicate with the first compartment.

In Aspect XII there is provided an air passage forming a closed loop circulation path with a first compartment when a door is in a first position.

In Aspect XIII there is provided an air passage that directs cooled air into a second compartment from an evaporator when a door is in a second position.

In Aspect XIV there is provided an air passage that is a single conduit extending between a first compartment and a second compartment.

In Aspect XV there is provided a partition that is not part of a uniform expanding foam material applied to a space between a liner and a metal shell of a refrigeration appliance.

In Aspect XVI there is provided a liner that defines a compartment for storing food items in a refrigerated environment. A rear wall of the liner is contoured to define a first horizontal recess therein. A partition includes a protrusion extending from a rear edge of the partition. The protrusion is disposed in the first horizontal recess in the liner when the partition is positioned in the compartment. An opening extends through the protrusion between opposite side surfaces of the partition. The opening is aligned with the first horizontal recess in the liner. The side inlet opening of the vertical partition fluidly communicates with the first horizontal recess in the liner and the opening extending through the partition. An evaporator fan is disposed in the first compartment for conveying cooling air from the evaporator through the opening extending through the partition, through the side inlet opening in the body, through the air passage in the body, through the at least one outlet opening in the body and exhausts the cooling air into the second compartment.

In Aspect XVII there is provided a liner that is contoured to define a second horizontal recess fluidly connecting a first compartment and a second compartment, wherein air drawn by an evaporator fan in the first compartment is drawn from the second compartment through a second horizontal recess.

In Aspect XVIII there is provided a refrigeration appliance that includes a compartment for storing food items in a refrigerated environment. A vertical partition divides the compartment into a first compartment and a second compartment. The first compartment is disposed horizontally adjacent the second compartment. The first compartment has a user-selectable target freezer temperature. The second compartment has a user-selectable target variable climate zone temperature between a predetermined temperature below 0 degrees Centigrade and a predetermined temperature above 0 degrees Centigrade. The vertical partition defines a through passage between the first compartment and the second compartment. A temperature control module is positioned in the second compartment. The temperature control module includes a body having a front surface and a rear surface. The rear surface faces a rear wall of the second compartment and the front surface faces an open end of the second compartment. An air passage is formed in the body extending between a side inlet opening of the body and at least one outlet opening on the front surface of the body. The side inlet opening of the air passage is aligned with the through passage in the vertical partition between the first compartment and the second compartment. A second inlet opening extends through the front surface of the body to the air passage. A damper assembly is positioned proximate the air passage. The damper assembly includes a door moveable between a first position and a second position. When the door is in the first position the door fluidly isolates the through passage in the vertical partition from the first compartment while allowing the second inlet opening in the body to fluidly communicate with the air passage in the body.

In Aspect XIX there is provided a door that, when in a second position the door fluidly isolates a second inlet opening in a body from an air passage in the body while allowing a through passage in a vertical partition to fluidly communicate with a first compartment.

In Aspect XX there is provided a heater assembly that is disposed between a front surface and a rear surface of a body proximate an air passage wherein air in the air passage is heated by a heater assembly when the heater assembly is energized.

In accordance with Aspect XXI there is provided a refrigerator 10 that includes an inner liner 72 defining an upper fresh food compartment 74 and a lower compartment 76, a vertical mullion 100 partitioning the lower compartment 74 into a freezer compartment 120 and a convertible temperature compartment 200. An evaporator cover 130 is arranged within the freezer compartment 120 to define an evaporator chamber 174. An evaporator 158 is arranged in the evaporator chamber 174 between the inner liner 72 and the evaporator cover 130. An evaporator fan 156 fluidly communicates with the evaporator chamber 174. A through passage 102 is provided in the vertical mullion 100 and a damper 292 is provided to selectively open and close the through passage 102. The evaporator cover 130 includes a plurality of outlets 138*a*, 138*b*, 138*c* for conveying cooling air from the evaporator chamber 174 to the freezer compartment 120. A lower surface 136*b* of the evaporator cover 130 guides air from the freezer compartment 120 into the evaporator chamber 174. An upper duct 152 fluidly connects to an outlet of the evaporator fan 156 for conveying cooling air from the evaporator 158 to the through passage 102 of the vertical mullion 100. A bottom portion of the evaporator chamber 174 includes an opening 168 fluidly connecting the convertible temperature compartment 200 to the evaporator chamber 174. The evaporator cover 130 and the inner liner 72 define a return flow path for drawing air from the convertible temperature compartment 200 to the evaporator 158 when the damper 292 opens the through passage 102.

In Aspect XXII there is provided an evaporator cover 130 that includes a front partition 134 facing an open end of a freezer compartment 120. A radial fan 156 is fixed to a rear side of the front partition 134. A fan shroud 172 is fixed to the rear side of the front partition 134 and defines an inlet 172*a* for the radial fan 156. A back element 144 is arranged (sandwiched) between the fan shroud 172 and rear side of the front partition 134 to form an air passage to guide cooling air from an evaporator 158 to a plurality of outlets 138*a*, 138*b*, 138*c* and an upper duct 152.

In Aspect XXIII there is provided a front partition 134 made of plastic.

In Aspect XXIV there is provided a back element 144 made from expanded polystyrene (EPS).

In Aspect XXV there is provided a refrigerator 10 including an inner liner 72 defining an upper fresh food compartment 74 and a lower compartment 76. A vertical mullion 100 partitioning the lower compartment 76 into a freezer compartment 120 and a convertible temperature compartment 200. A through passage 102 is provided at the vertical mullion 100 and a damper 292 selectively opens and closes the through passage 102. An evaporator 158 is arranged within the freezer compartment 120 and an evaporator fan 156 is arranged in the freezer compartment 120 for conveying cooling air from the evaporator 158 to the through passage 102 of the vertical mullion 100 to cool the convertible temperature compartment 200. The convertible temperature compartment 200 includes a vertical partition 222 having a front side facing an open end of the convertible temperature compartment 200 and a rear side facing the inner liner 72. A first air passage chamber 232 is formed in the rear side of the vertical partition 222. A fan 274 is arranged in the first air passage chamber 232 and fluidly connects to the through passage 102 of the vertical mullion 100. A second air passage chamber 94 is formed in the rear side of the vertical partition 222 and fluidly connects to the evaporator fan 156 of the freezer compartment 120. The second air passage chamber 94 is positioned below the first air passage chamber 232 and is fluidly separated from the first air passage chamber 232 within the convertible temperature compartment 200. The vertical partition 222 includes on the front side a plurality of outlets 222*a*, 222*b*, 222*c* fluidly connected to the first air passage chamber 232 for conveying cooling air from the evaporator 158 of the freezer compartment 120 to the convertible temperature compartment 200. A lower (guide) surface 226 extends to a bottom portion of the convertible temperature compartment 200 and fluidly connects to the second air passage chamber 94 for drawing air from the convertible temperature compartment 200 to the evaporator 158 of the freezer compartment 120.

In Aspect XXVI there is provided a refrigerator 10 comprising a compartment 200 defining laterals walls 76*a*, 76*b*, 76*c*, 104*a* a rear wall 76*d* and a front opening associated to a door 202. The compartment 200 includes an airflow assembly 220 comprising a front cover 222 with an inlet 224 and an outlet 222*a*, 222*b*, 222*c* in fluidly communication with the compartment 200. A radial fan 274 is fixed behind the front cover 222. A fan shroud 284 is fixed to the front cover 222 and defines an inlet 288 for the radial fan 274. A first heat-insulating element 244 is arranged between the fan shroud 284 and the front cover 222. The airflow assembly 220 further includes a second heat-insulating element 262 arranged between the first heat-insulating element 244 and the rear wall 76*d* of the compartment 200. The first heat-insulating element 244 and the second heat-insulating element 262 forming an air flow path D for conveying cooling air to the compartment 200.

In Aspect XXVII there is provided a front cover 222 made of plastic.

In Aspect XXVIII there is provided at least one of a first heat-insulating element 244 and a second heat-insulating element 262 made from expanded polystyrene (EPS).

In Aspect XXIX there is provided a first heat-insulating element 244 sandwiched between a fan shroud 284 and a front cover 222.

It is contemplated that an embodiment the present invention may include one or more combinations of any of the aforementioned Aspects. The following are example combinations of the foregoing Aspects and is not intended to limited the present invention to any specific combination of Aspects: the combination of Aspects I, II and III; the combination of Aspects I, III and IV; the combination of Aspects XI, XII and XIII; the combination of Aspects XI, XIII and XIV; the combination of Aspects XVIII, XIX and XX; the combination of Aspects XXI and XXII; the combination of Aspects XXI and XXIII; the combination of Aspects XXI and XXIV; the combination of XXV and XXII; the combination of Aspects XXVI and XXVII; the combination of Aspects XXVI and XXVIII; and the combination of Aspects XXVI and XXIX.

DESCRIPTION OF EXAMPLE EMBODIMENTS

Figure 1:
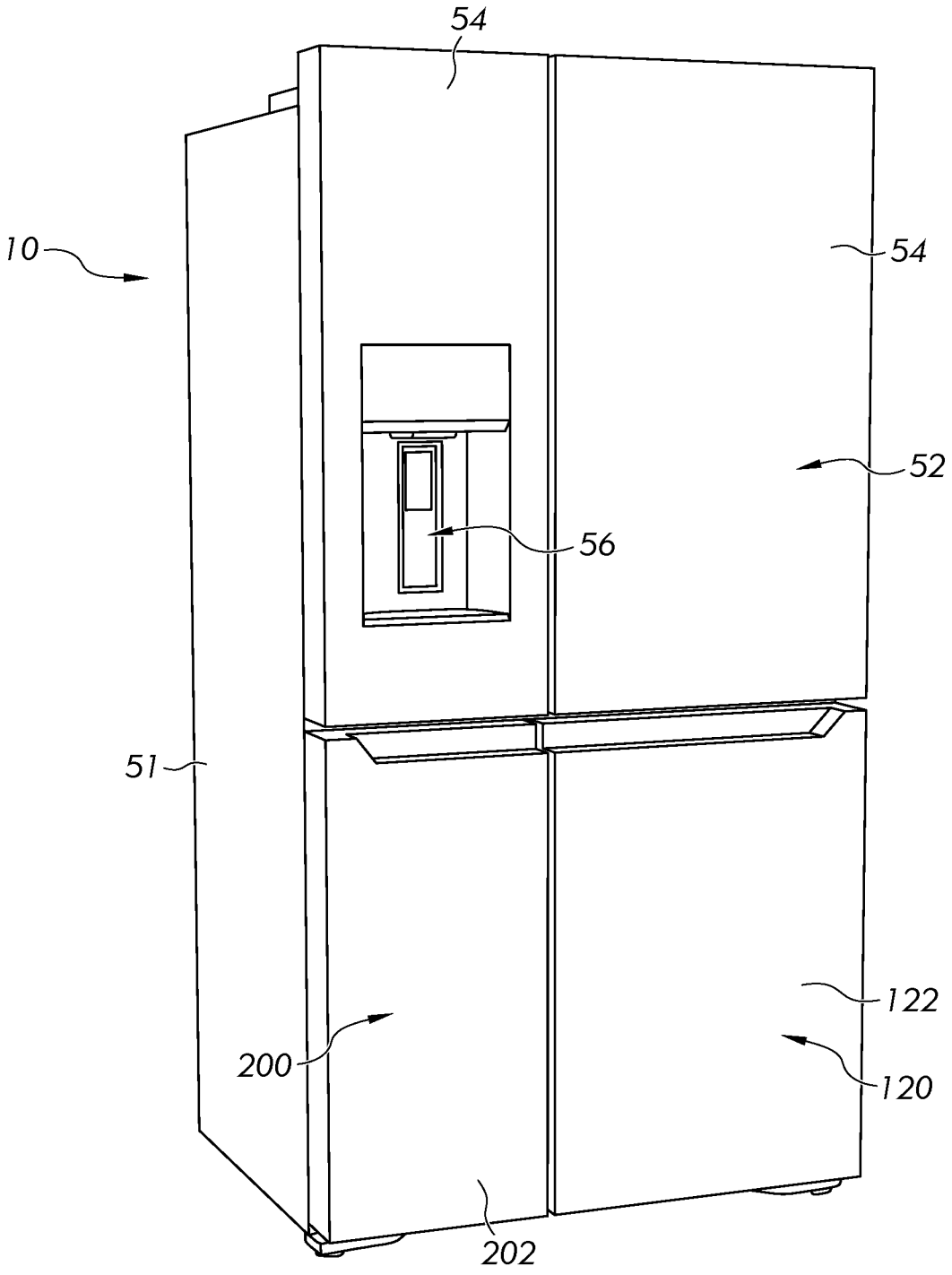
FIG. 1 is a front perspective view of a household French Door Bottom Mount refrigerator showing doors of a fresh food compartment, a freezer compartment and a variable climate zone compartment in a closed position.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 52 disposed vertically above a convertible temperature or variable climate zone (VCZ) compartment 200 and a freezer compartment 120.

Two doors 54 shown in FIG. 1 are pivotally coupled to a cabinet 51 of the refrigerator 10 to restrict and grant access to the fresh food compartment 52. The doors 54 are French-type doors that collectively span the entire lateral distance of the entrance to the fresh food compartment 52 to enclose the fresh food compartment 52. A center flip mullion (not shown) is pivotally coupled to at least one of the doors 54 to establish a surface against which a seal provided to the other one of the doors 54 can seal the entrance to the fresh food compartment 52 at a location between opposing side surfaces (not shown) of the doors 54. The mullion can be pivotally coupled to the door 54 to pivot between a first orientation that is substantially parallel to a planar surface of the door 54 when the door 54 is closed, and a different orientation when the door 54 is opened. The externally-exposed surface of the center mullion is substantially parallel to the door 54 when the center mullion is in the first orientation, and forms an angle other than parallel relative to the door 54 when the center mullion is in the second orientation. The seal and the externally-exposed surface of the mullion cooperate at a position offset from a centerline midway between the lateral sides of the fresh food compartment 52. It is contemplated that the seal and the externally-exposed surface of the mullion can cooperate approximately midway between the lateral sides of the fresh food compartment 52.

A dispenser 56 (FIG. 1) for dispensing at least ice pieces, and optionally water, can be provided on an exterior of one of the doors 54 that restricts access to the fresh food compartment 52. The dispenser 56 includes a lever, switch, proximity sensor or other device that a user can interact with to cause frozen ice pieces to be dispensed from an ice bin (not shown) of an ice maker 58 (FIG. 2) disposed within the fresh food compartment 52. Ice pieces from the ice maker 58 can exit the ice maker 58 through an aperture 59 and be delivered to the dispenser 56 via an ice chute 61 which extends at least partially through the door 54 between the dispenser 56 and the ice maker 58.

Refrigerator Liner 72

Figure 2:
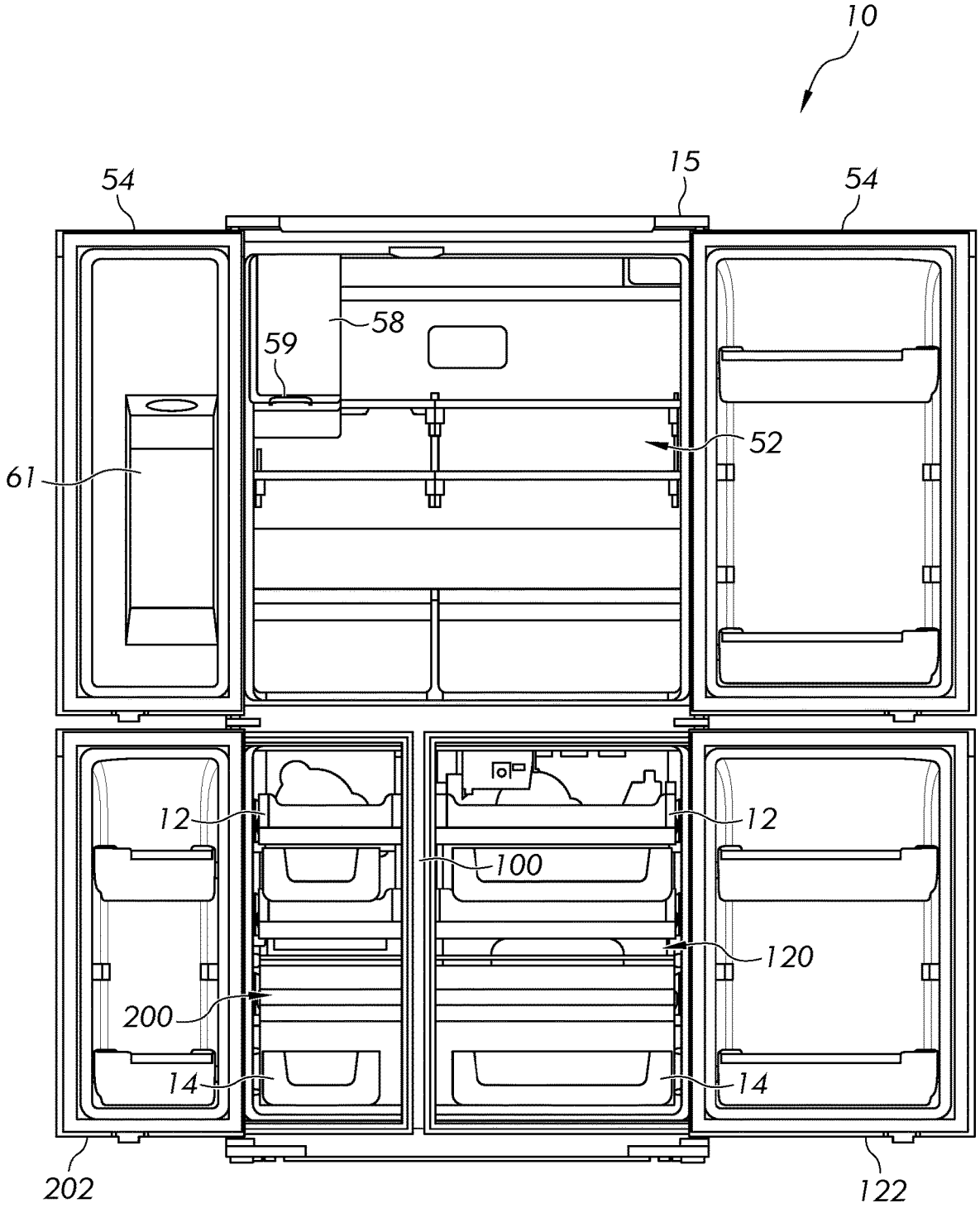
FIG. 2 is a front perspective view of the refrigerator of FIG. 1 showing the doors of the refrigerator in an open position.
Figure 3:
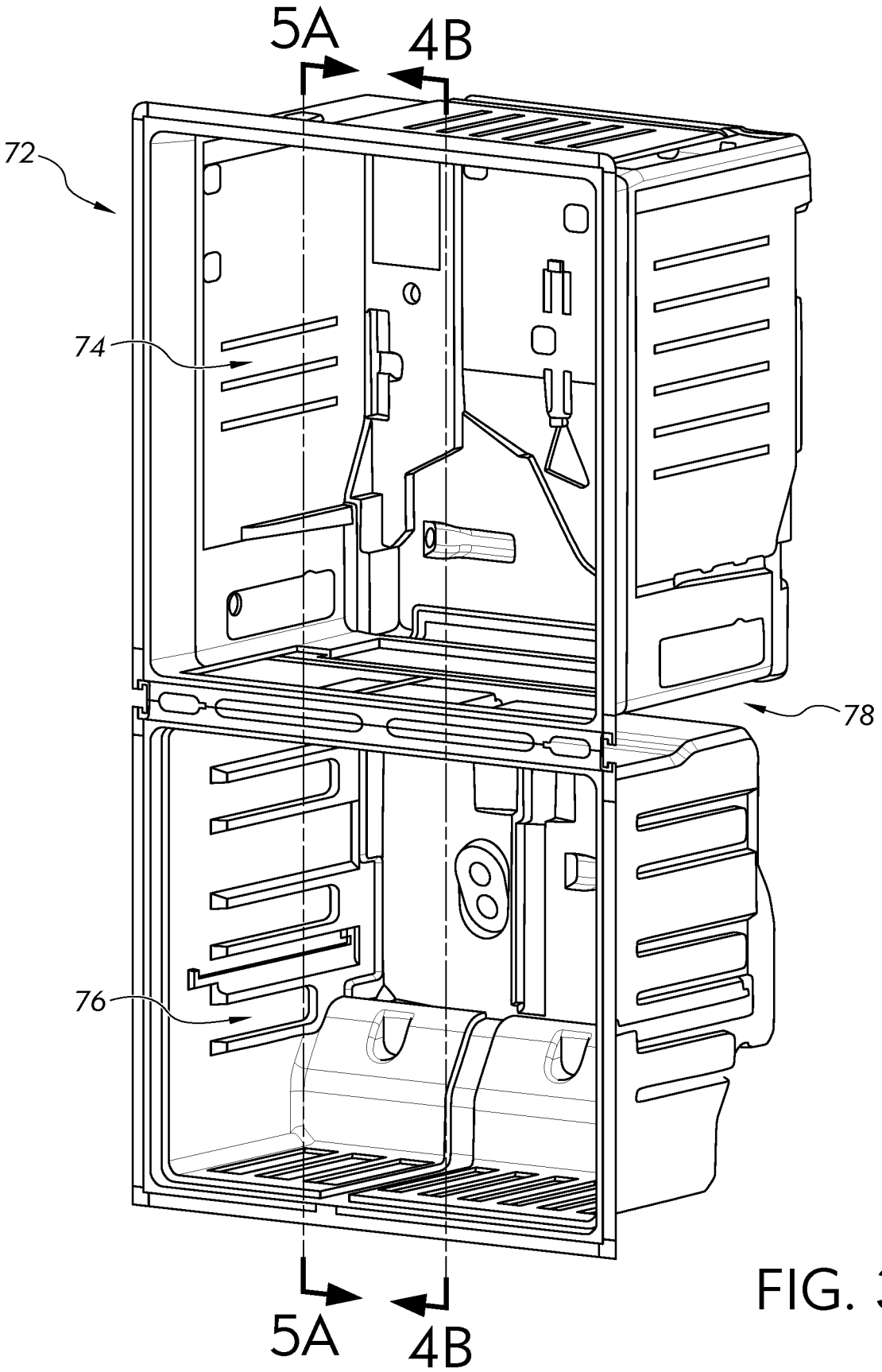
FIG. 3 is a front perspective view showing a liner of the refrigerator of FIG. 1 for the fresh food compartment, the freezer compartment and the variable climate zone compartment

The refrigerator 10 includes an inner liner 72. Referring to FIG. 3, the liner 72 is formed to define an upper compartment 74 and a lower compartment 76. Although illustrated as a single liner that defines both compartments 74, 76, it is contemplated that these could be separate liners for each compartment. The inner liner 72 is contained within an outer metal shell that defines the exterior of the refrigerator 10 (FIG. 2). It is contemplated that a space 78 between the upper compartment 74 and the lower compartment 76 may be filled with a uniform expanding foam material (not shown). The foam material is configured to aid in thermally isolating the upper compartment 74 and the lower compartment 76, and further cures to a rigid form that aids in structurally supporting the various compartments of the refrigerator.

The upper compartment 74 defines the fresh food compartment 52 which serves to minimize spoiling of articles of food stored therein. The fresh food compartment 52 accomplishes this by maintaining the temperature in the fresh food compartment 52 at a cool temperature that is typically above 0° C., so as not to freeze the articles of food in the fresh food compartment 52. It is contemplated that the cool temperature is a user-selectable target fresh food temperature, preferably between 0° C. and 10° C., more preferably between 0° C. and 5° C. and even more preferably between 0.25° C. and 4.5° C. A fresh food evaporator (not shown) is dedicated to separately maintaining the temperature within the fresh food compartment 52 independent of the freezer compartment 120. According to an embodiment, the temperature in the fresh food compartment 52 can be maintained at a cool temperature within a close tolerance of a range between 0° C. and 4.5° C., including any subranges and any individual temperatures falling with that range. For example, other embodiments can optionally maintain the cool temperature within the fresh food compartment 52 within a reasonably close tolerance of a temperature between 0.25° C. and 4° C.

The upper compartment 74 and the lower compartment 76 of the liner 72 are configured such that the air circulated in the upper compartment 74 is maintained separated from the air circulated in the lower compartment 76. The lower compartment 76 defines the freezer compartment 120 and the VCZ compartment 200. In this respect, the air circulated in the fresh food compartment 52 is maintained separated from the air circulated in the VCZ compartment 200 and the freezer compartment 120.

Figure 4A:
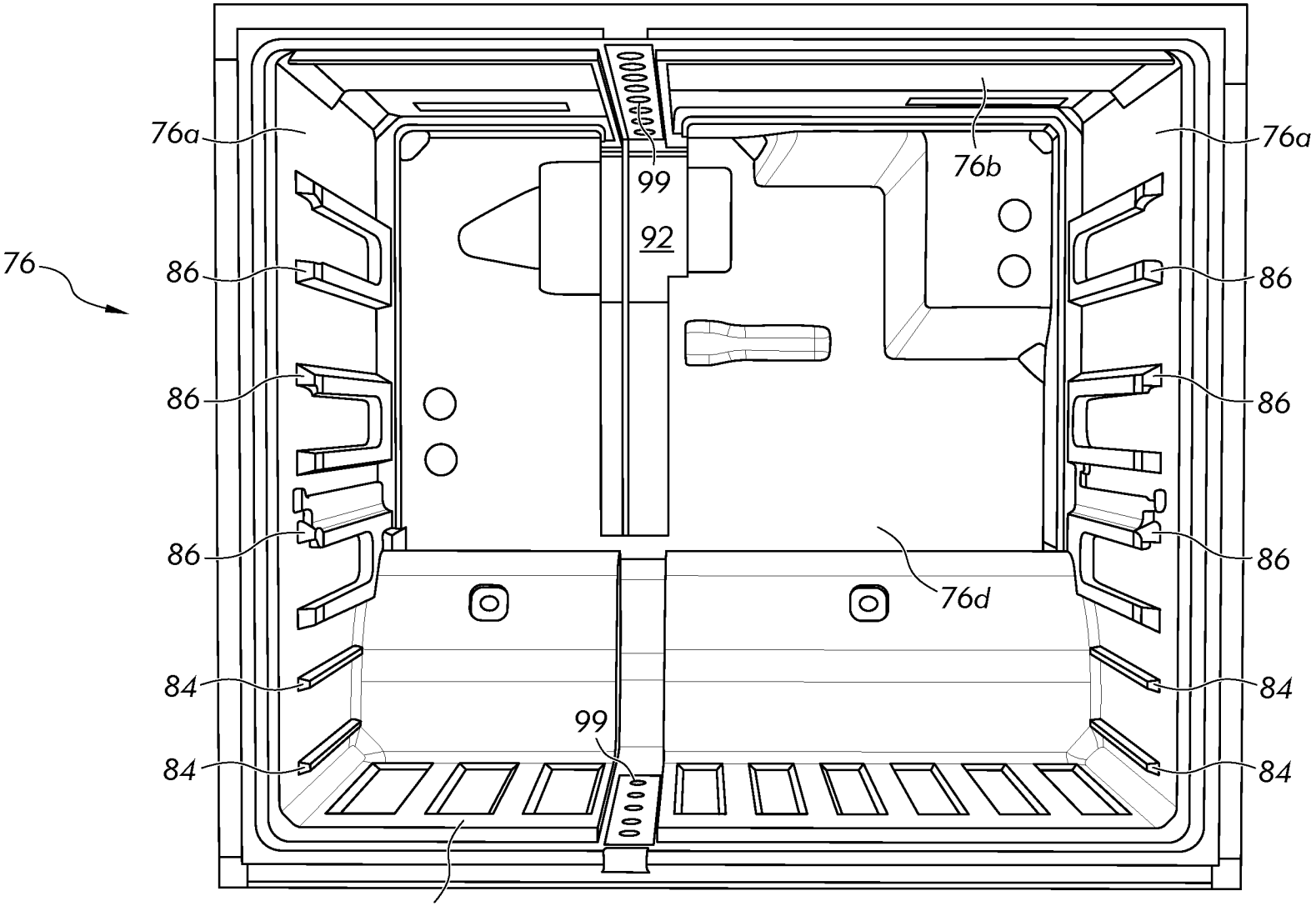
FIG. 4A is a front perspective view showing a lower compartment of the liner of FIG. 3.

Referring to FIG. 4A, the lower compartment 76 includes side walls 76*a*, a top wall 76*b*, a bottom wall 76*c* and a rear wall 76*d*. A plurality of horizontal receivers 82 are molded into both side walls 76*a*. The receivers 82 may be configured to receive a drawer support (not shown) that, in turn, receives a fixed or movable slide assembly (not shown) for supporting shelves 12 (FIG. 2) in the freezer compartment 120 or the VCZ compartment 200. In the embodiment shown, the receivers 82 are U-shaped with an open end facing an opening of the lower compartment 76. A plurality of horizontal ledges 84 may also be formed in the side walls 76*a* below the receivers 82. Each ledge 84 may be configured to support a bin 14 (FIG. 2) in the freezer compartment 120 or the VCZ compartment 200. Each bin 14 may include a roller assembly (not shown) for allowing the bin 14 to be selective slide in and out of the respective freezer compartment 120 or the VCZ compartment 200. The ledges 84 are dimensioned and positioned as described in detail below.

Figure 4B:
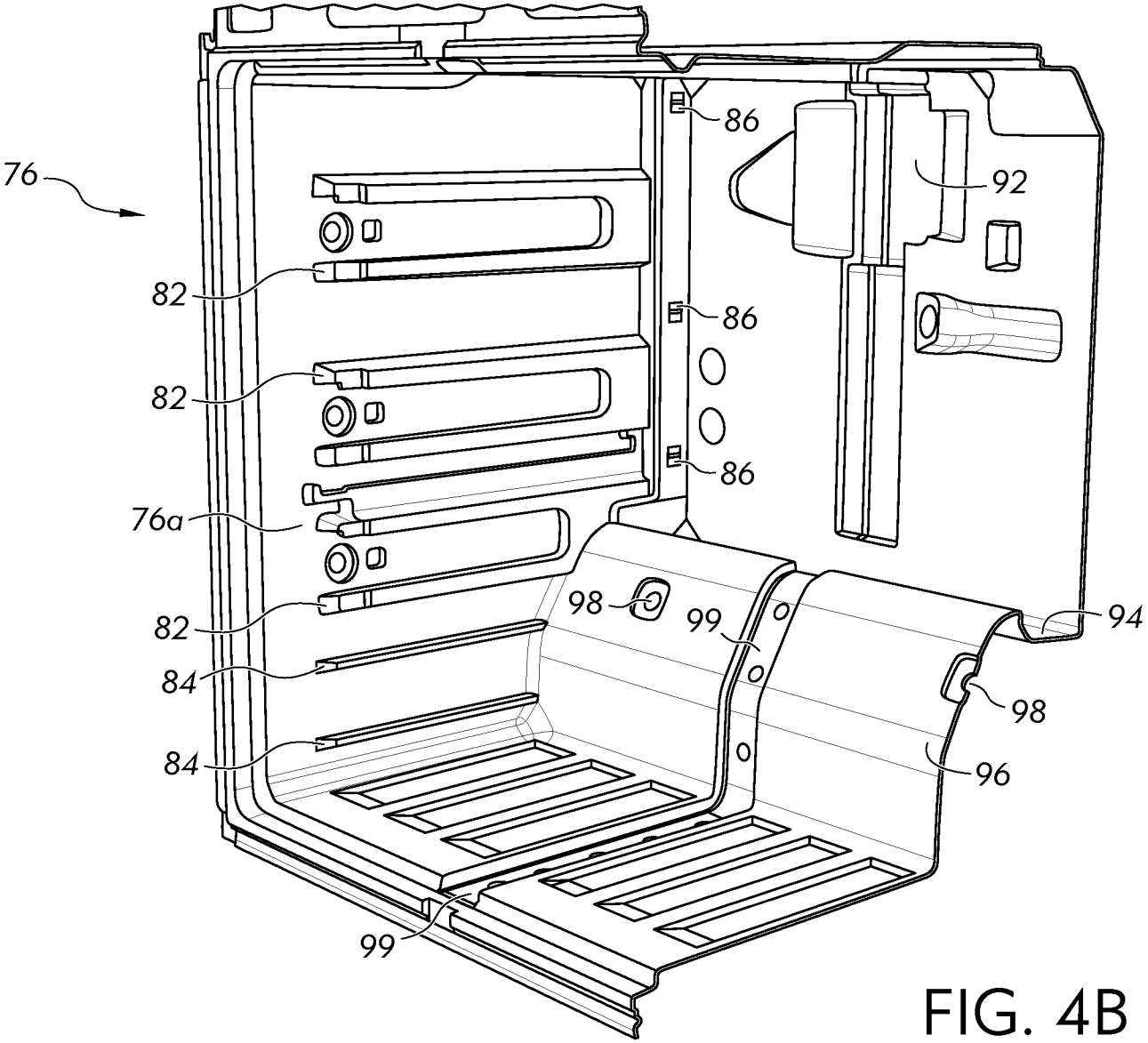
FIG. 4B is a section view of the liner of FIG. 3 taken along a line 4B-4B.

Referring to FIG. 4B, a cross-section view of the lower compartment 76 is shown. A plurality of recesses 86 are formed in the side wall 76*a*. The recesses 86 are spaced along the side wall 76*a* and are dimensioned and positioned as described in detail below. Similar recesses (not shown) are formed in the opposite side wall 76*a*. The rear wall 76*d* is contoured to define a recess 92 that extends in a generally horizontal direction. As described in detail below, the recess 92 extends between the freezer compartment 120 and the VCZ compartment 200 for allowing fluid communication therebetween.

A corner portion of the liner 72 where the rear wall 76*d* meets the bottom wall 76*c* is contoured to define a gully or channel 94 that extends between the side walls 76*a* of the lower compartment 76. As described in detail below, the gully or channel 94 extends between the freezer compartment 120 and the VCZ compartment 200 for allowing fluid communication therebetween.

The bottom wall 76*c* includes a generally sloped portion 96. Mounting holes 98 extend through the sloped portion 96 of the bottom wall 76*c* and are positioned and dimensioned as described in detail below. An elongated recess 99 is formed in the top wall 76*b* (FIG. 4A), the bottom wall 76*c* and the rear wall 76*d* for receiving a vertical mullion or partition 100 for dividing the lower compartment 76 into the freezer compartment 120 and the VCZ compartment 200.

Partition 100

Figure 5A:
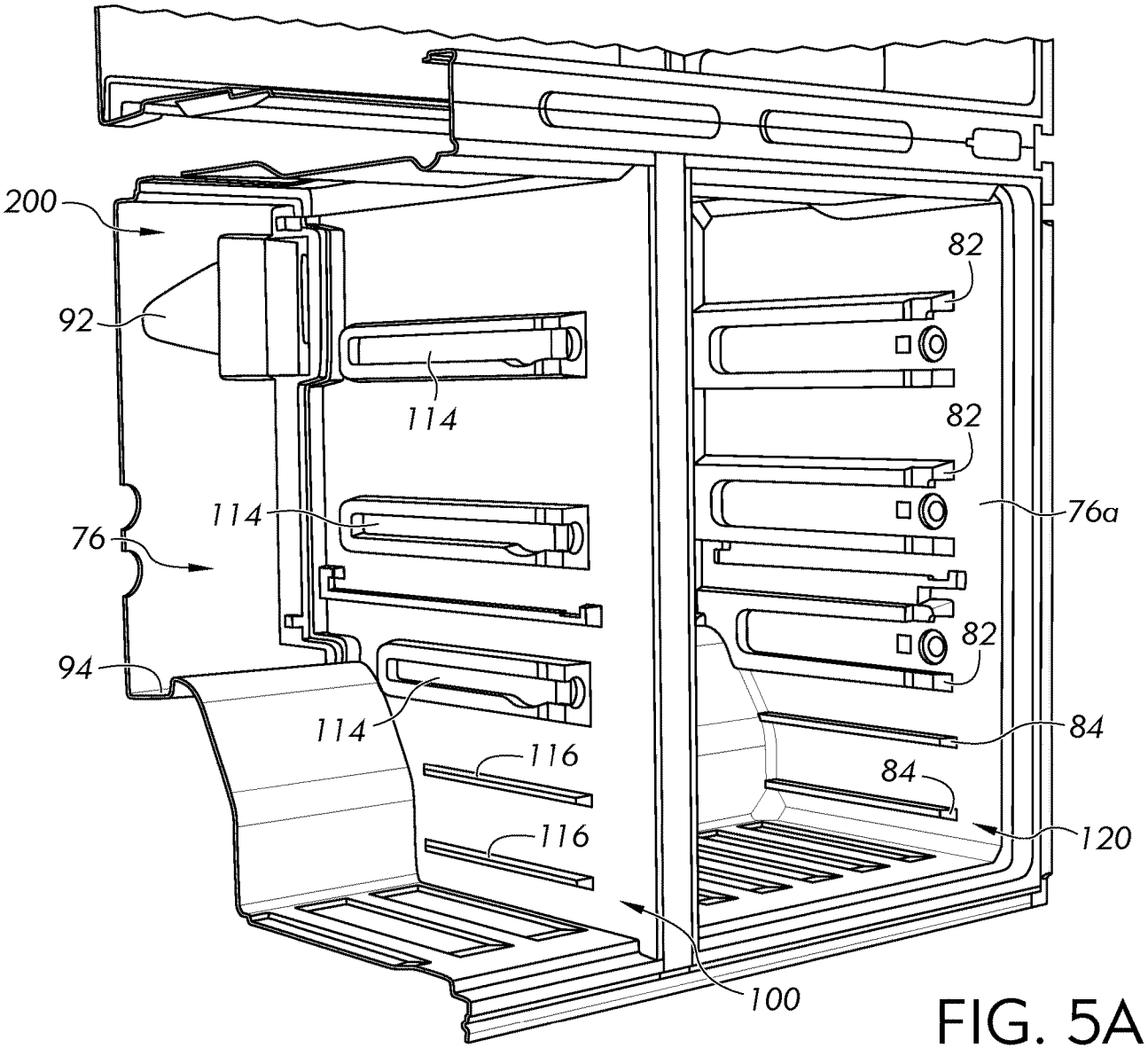
FIG. 5A is another section view of the liner of FIG. 3 from a different angle and taken along a line 5A-5A with a partition disposed in the lower compartment of the liner.
Figure 5C:
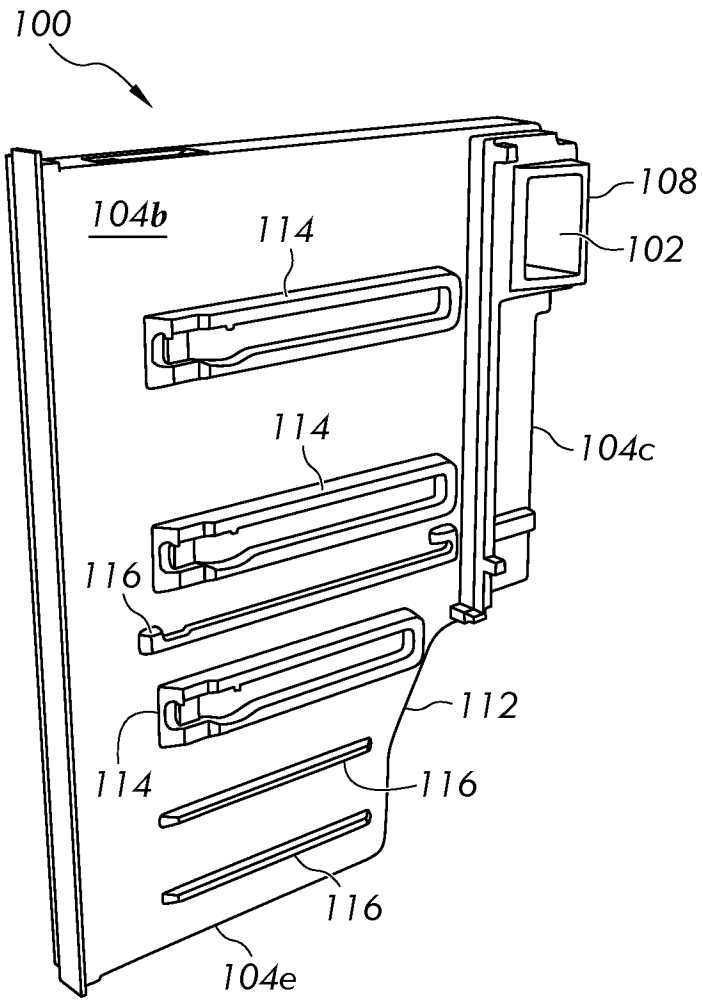
FIG. 5C is an opposite side perspective view of the partition of FIG. 5A.
Figure 5B:
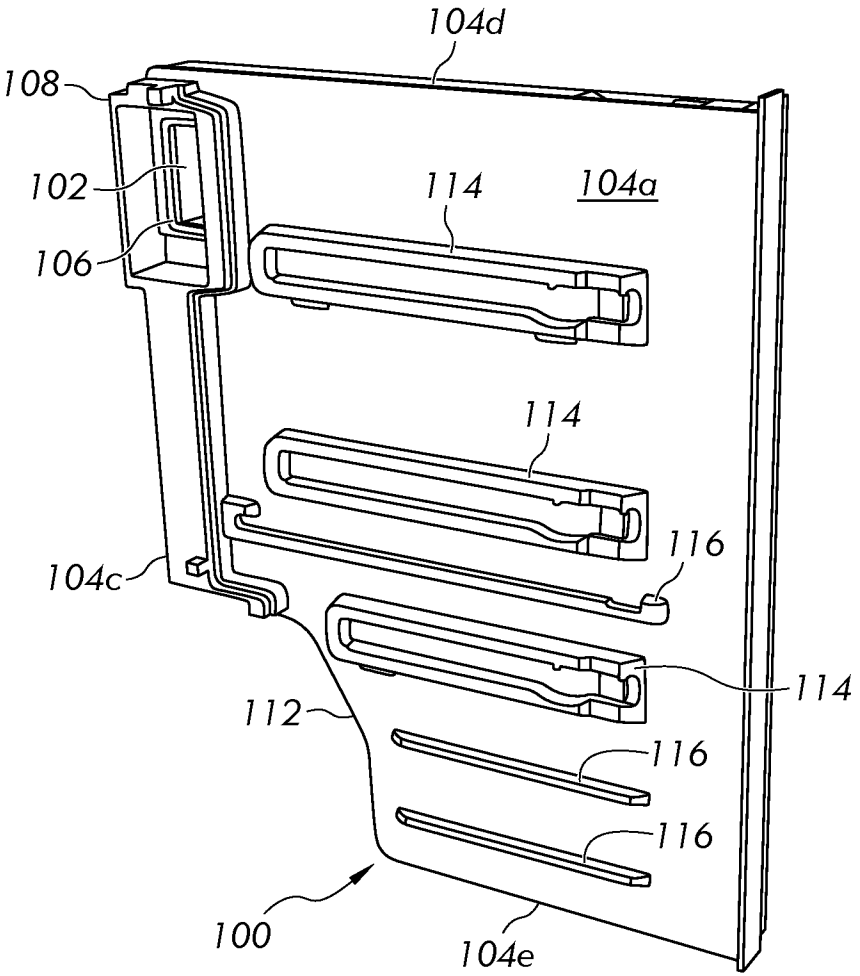
FIG. 5B is one side perspective view of the partition of FIG. 5A.

Referring to FIG. 5A, the partition 100 is disposed in the lower compartment 76 for separating the lower compartment 76 into the freezer compartment 120 and the VCZ compartment 200. Referring to FIGS. 5B and 5C, the partition 100 includes a through passage or opening 102 extending between a first side surface 104*a* and a second side surface 104*b* of the partition. The opening 102 allows fluid to flow through the partition 100 to establish fluid communication between the freezer compartment 120 and the VCZ compartment 200. The opening 102 is shown as an elongated rectangular opening. It is contemplated that the opening 102 may have other shapes, e.g., circular, oval, square, etc. A seat 106 may be formed in the opening 102. As shown, the seat 106 extends about a periphery of the opening 102. It is contemplated that the seat 106 may be a continuous ledge that extends about the opening 102, a plurality of segmented ledges or discrete ledges at one or more corners or sides of the opening 102. The seat 106 is dimensioned and positioned as described in detail below.

The partition 100 includes a rear 104*c* and a top 104*d* and a bottom 104*e*. The rear 104*c* is contoured to match the contour of the rear wall 76*d* of the lower compartment 76. As shown, the rear 104*c* of the partition 100 includes a protrusion 108. The opening 102 aligns with the protrusion 108. It is contemplated that the opening 102 may at least partially extend through the protrusion 108. The protrusion 108 is dimensioned and positioned as described in detail below. A notch 112 is formed in the corner between the rear 104*c* and the bottom 104*e* of the partition 100 and is contoured to match the sloped portion of 96 of the liner 72.

As shown in FIGS. 5B and 5C, a plurality of horizontal drawer supports 114 may be formed in the first side surface 104*a* and the second side surface 104*b*. Each drawer support 114 may be configured to receive a fixed or movable slide assembly (not shown) for supporting shelves 12 (FIG. 2) in the freezer compartment 120 or the VCZ compartment 200. In other words, the partition 100 includes drawer supports 114 that are formed integral with the side surfaces 104*a*, 104*b*, whereas the side walls 76*a* of the lower compartment 76 include receivers 82 that are dimensioned to receive separate drawer supports (not shown). A plurality of horizontal ledges 116 may also be formed in the first side surface 104*a* and the second side surface 104*b*. Each ledge 116 may be configured to support a bin 14 (FIG. 2) or optionally a glass shelf in the freezer compartment 120 or the VCZ compartment 200. Each bin 14 may include a roller assembly for allowing the bin 14 to be selective moved into and out of the respective freezer compartment 120 or the VCZ compartment 200. The ledges 116 are dimensioned and positioned as described in detail below.

It is contemplated that the partition 100 may be a "not foamed" element. The term "not foamed" is used herein with reference to the injected, flowing expanding foam used elsewhere in the refrigerator cabinet to mean that the partition 100 may not be permanently attached to the liner 72. Conventional partition walls or mullion walls in refrigerators are foamed insulations that cannot be removed, i.e., the partition wall or the mullion wall is a permanent structural wall of the refrigerator. It is contemplated that the partition 100 may be a "not foamed" element that is separate from the remainder of the injected, flowing expanding foam and may be removed from the refrigerator, if desired, so that the freezer compartment 120 occupies the entire lower compartment 76. However, it is to be appreciated that the interior of the partition 100 may still include an insulating material of various types, including an insulating foam material, so as to help maintain the desired temperatures of the freezer compartment 120 and the VCZ compartment 200.

Referring to FIG. 5A, the partition 100 is dimensioned to be received in the lower compartment 76 to thereby separate the freezer compartment 120 and VCZ compartment 200. In FIG. 5A, the partition 100 is shown fully inserted into the lower compartment 76. The partition 100 is positioned in the lower compartment 76 such that the protrusion 108 of the partition 100 (with the opening 102) is received into the recess 92 in the rear wall 76*d* of the lower compartment 76. Optionally, a seal member (not shown) may be disposed between the rear 104*c* and the rear wall 76*d* for defining a seal between the partition 100 and the rear wall 76*d* of the lower compartment 76. The top 104*d* and the bottom 104*e* (FIGS. 5B and 5C) of the partition 100 are received into the elongated recess 99 (FIG. 4B) formed in the top wall 76*b* and the bottom wall 76*c* of the lower compartment 76. Optionally, it is also contemplated that seal members (not shown) may be disposed between the top 104*d* and the bottom 104*e* of the partition 100 and the top wall 76*b* and the bottom wall 76*c* of the lower compartment 76, respectively, for defining a seal between the partition 100 and the top wall 76*b* and the bottom wall 76*c* of the lower compartment 76. Once the partition 100 is fully inserted into the lower compartment 76, fluid communication between the freezer compartment 120 and the VCZ compartment 200 may be established through the opening 102 and the gully or channel 94.

Further, the drawer supports 114 and the ledges 116 on the partition 100 are positioned and dimensioned to align with respective receivers 82 and ledges 84 on the side walls 76*a* of the respective freezer compartment 120 or the VCZ compartment 200. The receivers 82, the drawer supports 114 and ledges 84, 116 are positioned and dimensioned to support shelves 12 and bins 14 thereon, as illustrated in FIG. 2.

Freezer Compartment 120

Referring to FIG. 1, the freezer compartment 120 is arranged horizontally next to the VCZ compartment 200 and vertically below the fresh food compartment 52. A door assembly 122 (FIG. 1) including one or more freezer baskets (not shown) can be pivoted open to grant a user access to food items stored in the freezer compartment 120.

The freezer compartment 120 is used to freeze and/or maintain articles of food stored in the freezer compartment 120 in a frozen condition. For this purpose, the freezer compartment 120 includes an evaporator cover or freezer cooling module 130 (FIG. 6-8), described in detail below, that removes thermal energy from the freezer compartment 120 to maintain the temperature therein at a user-selectable target freezer temperature, e.g., a temperature of 0° C. or less during operation of the refrigerator 10, preferably between 0° C. and −50° C., more preferably between 0° C. and −30° C. and even more preferably between 0° C. and −20° C. The freezer compartment 120 is also in communication with the VCZ compartment 200 such that a portion of the cooling air supplied by the freezer cooling module 130 may be selectively supplied to the VCZ compartment 200.

Freezer Cooling Module 130

Figure 6:
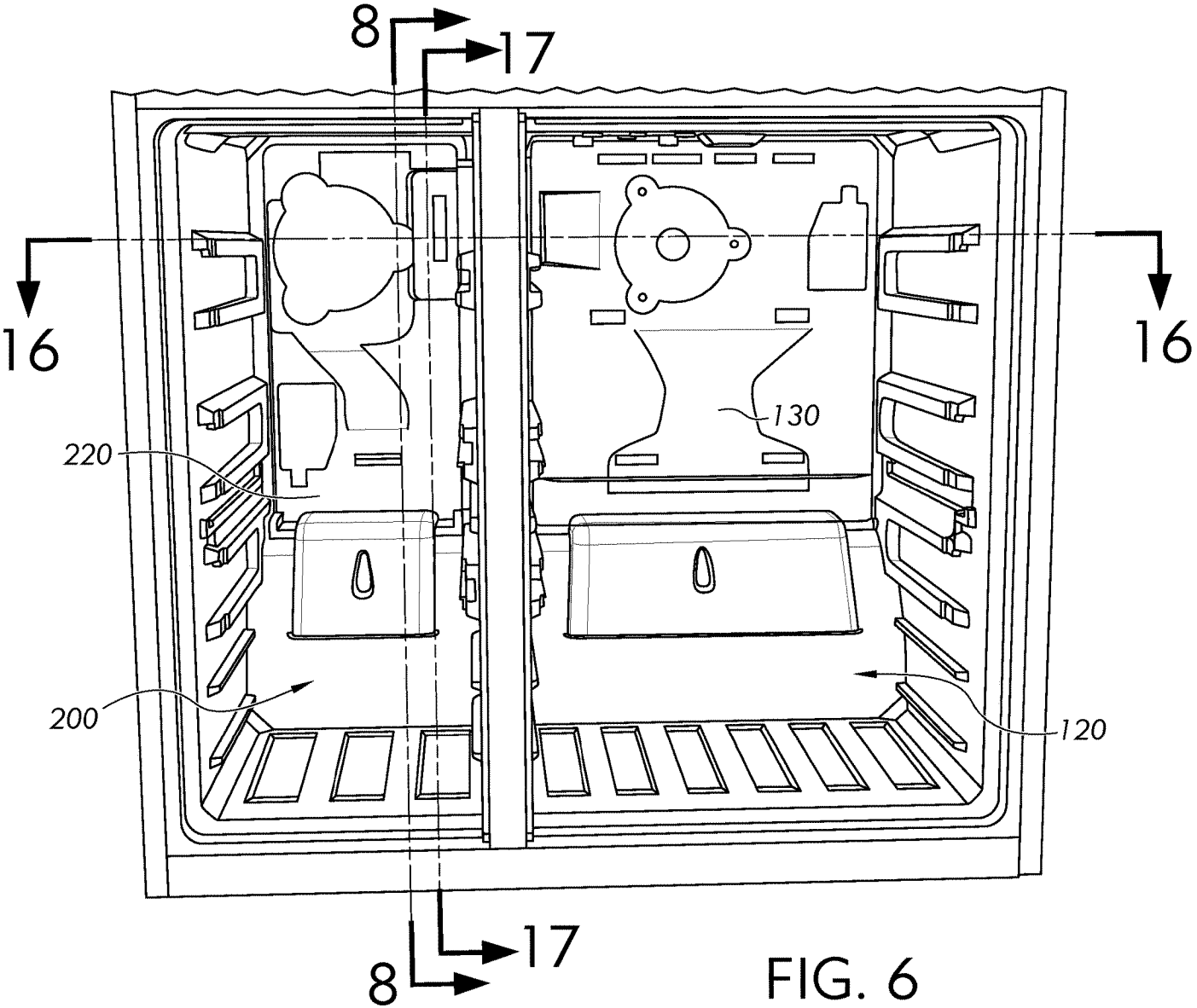
FIG. 6 is a front perspective view showing a freezer cooling module for the freezer compartment and a temperature control module for the variable climate zone compartment positioned in the lower compartment of FIG. 2 with bins and shelves removed.
Figure 7A:
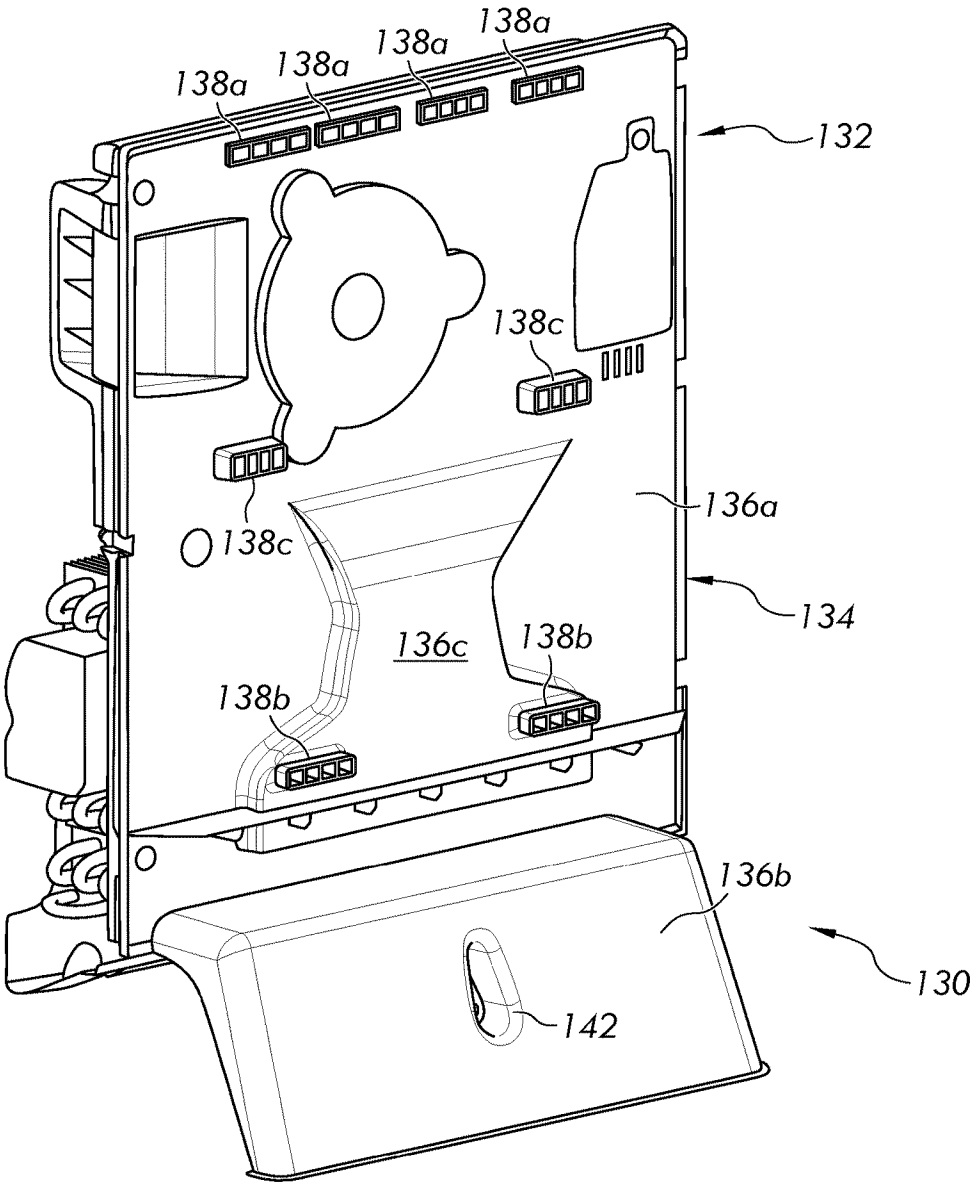
FIG. 7A is a front perspective view of the freezer cooling module of FIG. 6.

Referring to FIG. 6, the freezer cooling module 130 of the freezer compartment 120 and an airflow assembly or temperature control module 220 of the VCZ compartment 200 are shown disposed in their respective compartments 120, 200. Referring to FIGS. 7A-8, the freezer cooling module 130 is shown. In general, the freezer cooling module 130 includes a housing assembly 132, a freezer fan 156 and a freezer evaporator 158.

Referring to FIG. 7A, the housing assembly 132 includes a front partition or cover 134 and a back element or body 144. The cover 134 includes a front portion 136*a* and a lower surface or flange portion 136*b*. The front portion 136*a* is contoured and dimensioned to have various features that are aesthetically pleasing to a consumer. A plurality of openings 138*a*, 138*b*, 138*c* extends through the front portion 136*a*. The openings 138*a* are spaced apart near an upper edge of the front portion 136*a* and the lower openings 138*b* are spaced apart near a lower edge of the front portion 136*a*. The openings 138*c* are spaced apart in a mid-portion of the front portion 136*a*. The openings 138*a*, 138*b*, 138*c* define air outlets of the freezer cooling module 130, as described in detail below. The lower openings 138*b* are formed on a raised portion 136*c* of the cover 134. The raised portion 136*c* is positioned and dimensioned as described in detail below. It is contemplated that the cover 134 may be made from plastic.

The flange portion 136*b* extends from a lower front portion of the cover 134 at a location below the lower openings 138*b*. As shown, the flange portion 136*b* is a curved elongated element that is dimensioned and positioned as described in detail below. A mounting hole 142 extends through the flange portion 136*b*. The mounting hole 142 is positioned and dimensioned as described in detail below.

A plurality of tabs 143 (FIG. 7C) extends from an outer edge of the cover 134 for mounting the freezer cooling module 130 to the liner 72, as described in detail below. The plurality of tabs 143 is positioned and dimensioned and positioned as described in detail below.

Figure 7B:
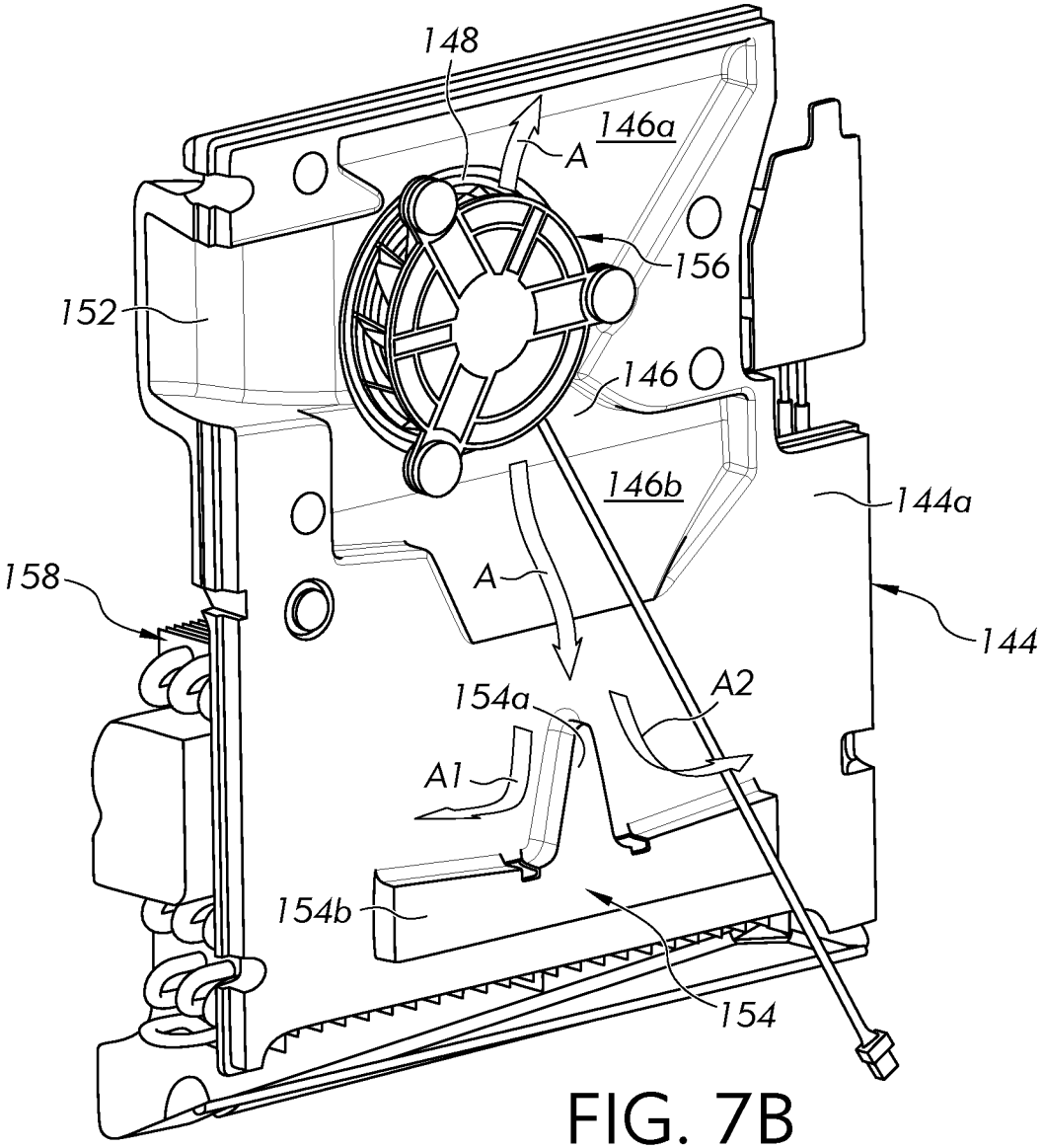
FIG. 7B is a front perspective view of the freezer cooling module of FIG. 7A with a cover of the module removed.
Figure 8:
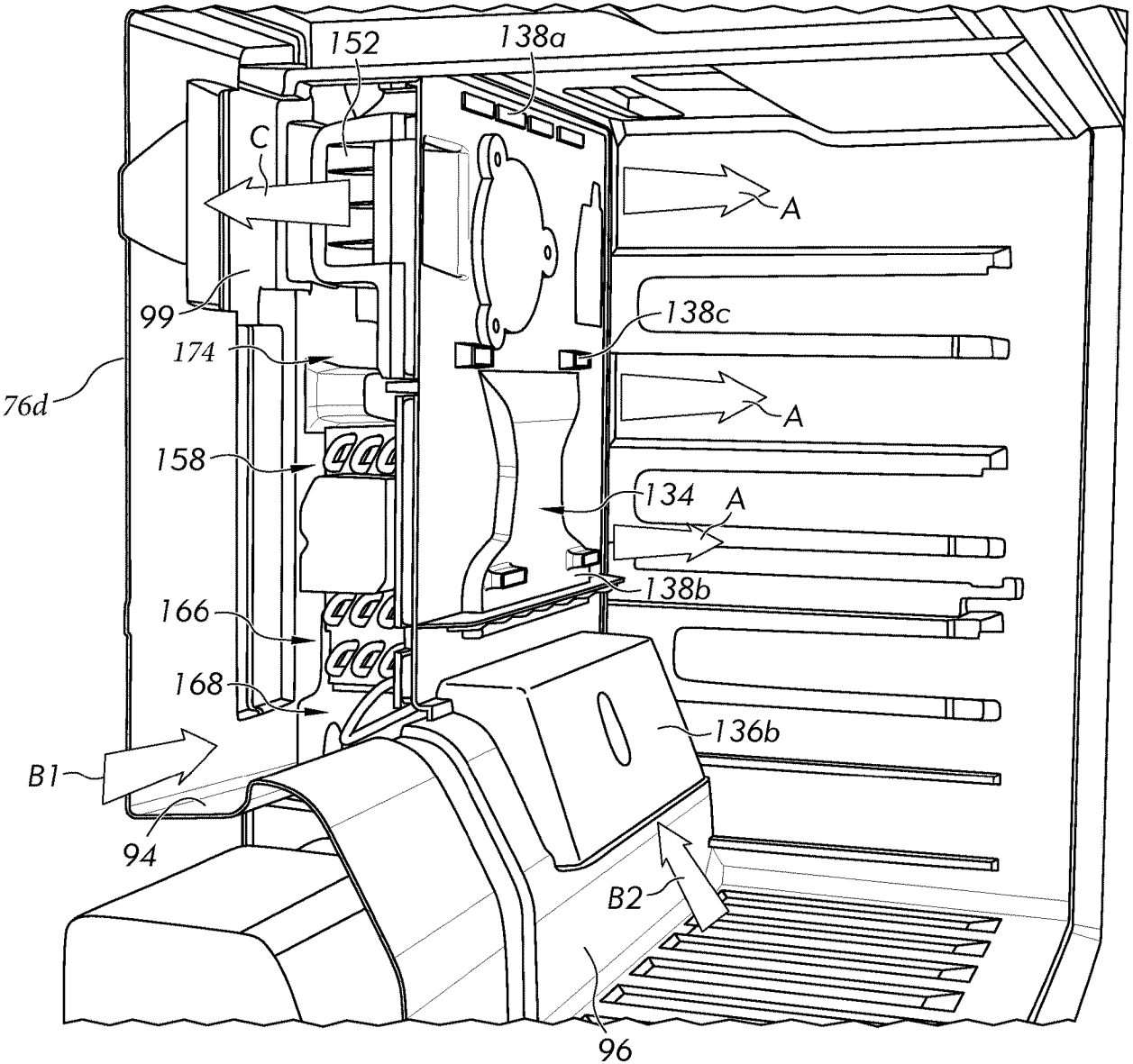
FIG. 8 is a section view of the assembly of FIG. 6 taken along a line 8-8 illustrating the freezer compartment with a freezer cooling module and partition removed.

Referring to FIG. 7B, the cover 134 of the housing assembly 132 is removed for clarity. A front surface 144*a* of the body 144 is contoured to form a recessed cavity 146. The recessed cavity 146 is formed around an opening 148 that extends through the body 144. The recessed cavity 146 includes an upper branch 146*a* and a lower branch 146*b*. The upper branch 146*a* of the recessed cavity 146 extends to a side edge of the body 144 to form an upper duct or outlet 152. In the embodiment shown, the outlet 152 is C-shaped. It is contemplated that the outlet 152 may have other shapes. The lower branch 146*b* extends toward a mid-portion of the body 144 and is positioned and dimensioned as described in detail below. It is contemplated that the body 144 may be made from expanded polystyrene (EPS).

A divider 154 extends from the front surface 144*a* of the body 144. In the embodiment shown, the divider 154 includes a base portion 154*a* and a center protruding portion 154*b*. The center protruding portion 154*b* is generally triangular in shape to divide an air path into two paths, as described in detail below.

The cover 134 is attached to the body 144 to close the recessed cavity 146 and thereby define in internal air path "A" of the freezer cooling module 130. It is contemplated that the cover 134 may be attached to the body 144 using elements such as, but not limited to, fasteners, adhesives, snap-fit features and combinations of the foregoing. As shown, the recessed cavity 146 is formed in the body 144 and the cover 134 closes an open side of the recessed cavity 146 to define the internal air path "A" into the freezer compartment 120, as described in detail below. As shown in FIG. 7B, the air path "A" is directed into an upwards and a downwards direction from the fan 156. As described in detail below, the air path "A" that is directed downwards is divided into two flow paths "A1" and "A2".

The raised portion 136*c* of the cover 134 is positioned over the divider 154 of the body 144 when the cover 134 is attached to the body 144. In particular, the center protruding portion 154*b* of the divider 154 extends into the raised portion 136*c* of the cover 134 to divide the corresponding area between the cover 134 and the body 144 into two flow paths "A1" and "A2" (FIG. 7B). One flow path is fluidly connected to one of the lower openings 138*b* in the cover 134 while the other flow path is fluidly connected to the other of the other lower opening 138*b* in the cover 134. Although the present embodiment is illustrated as having a single lower opening 138*b* connected to one flow path, it is contemplated that the cover 134 may include several lower openings 138*b* that communicate with one of the flow paths defined between the cover 134 and the body 144.

As illustrated, the body 144 is contoured to define recesses and raised surfaces that cooperate with contoured raised surfaces of the cover 134 to define various flow paths therebetween. It is contemplated that contoured features may be reversed so long as there are flow paths defined between the cover 134 and the body 144. It is also contemplated that the cover 134 and the body 144 may be replaced with a single monolithic body (e.g., a single molded component) and the internal passage may be formed, e.g., molded or machined into the single monolithic body.

Referring to FIG. 7B, the freezer fan 156 is positioned within the opening 148 formed in the body 144. The freezer fan 156 is shown as a centrifugal or radial fan wherein air is drawn in from a rear 156*a* (FIG. 7C) of the freezer fan 156 and exhausted outwards along a periphery of the freezer fan 156 (see airflow arrows "A", FIG. 7B). Various other types of fans may also be used (i.e., axial fans, etc.).

Figure 7C:
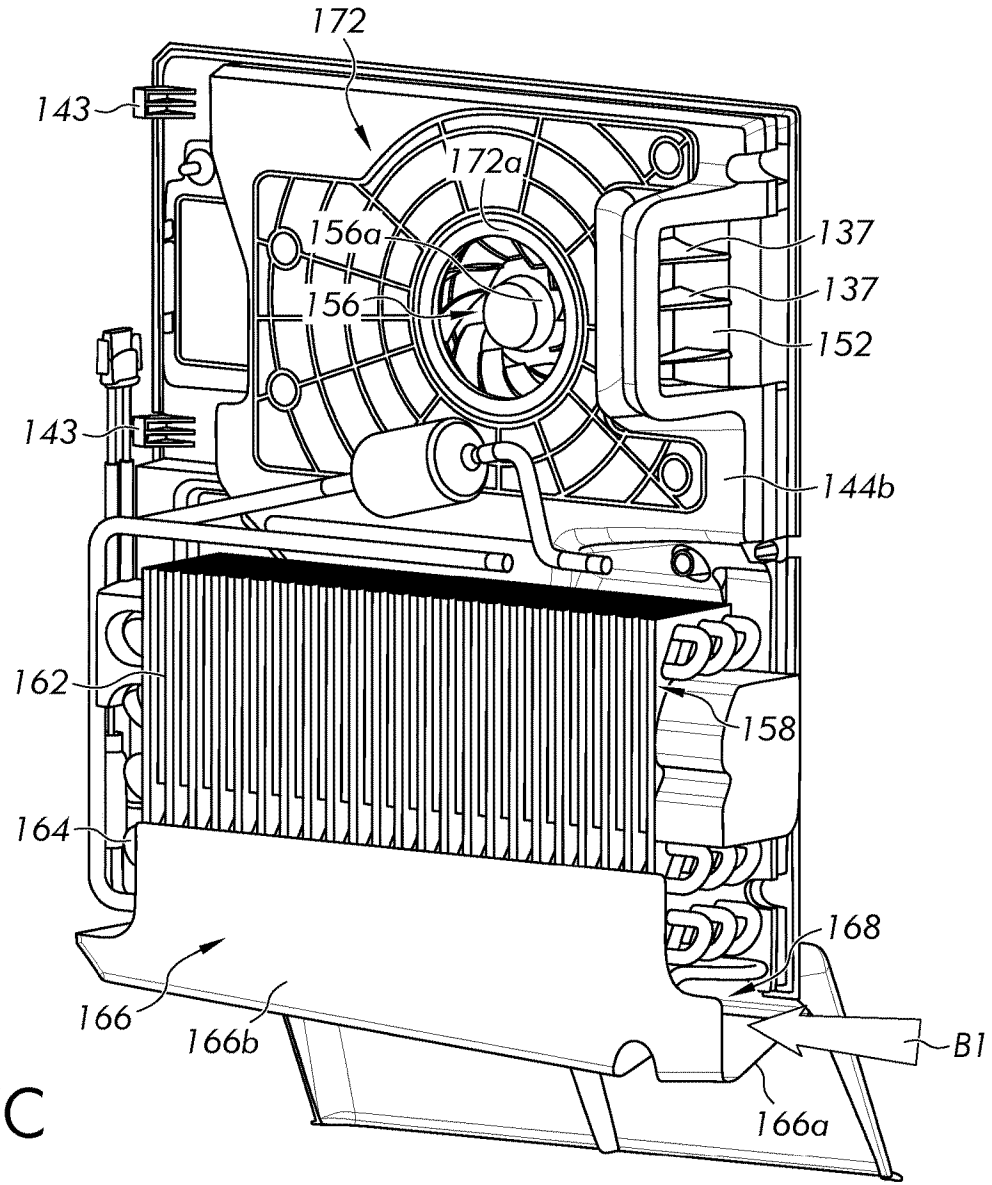
FIG. 7C is a rear perspective view of the freezer cooling module of FIG. 7A.

Referring to FIG. 7C, which illustrates a rear view of the freezer cooling module 130, the freezer evaporator 158 is positioned adjacent the rear surface 144*b* of the body 144.

The freezer evaporator 158 includes a plurality of fins 162 and a cooling coil 164 for drawing heat from air conveyed through the freezer evaporator 158 when a refrigerant is circulated through the cooling coils 164. The freezer evaporator 158 is attached to a frame member 166.

The frame member 166 includes a lower horizontal portion 166*a* that extends under the freezer evaporator 158 and a vertical portion 166*b* that extends along a rear side of the freezer evaporator 158. The lower horizontal portion 166*a* is spaced from a bottom of the freezer evaporator 158 to define an opening or gap 168 therebetween. The gap 168 defines a portion of a return flow path "B1" from the VCZ compartment 200 to the freezer evaporator 158, as described in detail below.

The cover 134 may include a plurality of fins 137 that extend into the outlet 152 formed in the body 144. The fins 137 may be contoured to direct the air exiting the outlet 152 into a predetermined direction.

A fan shroud or mounting plate 172 may be mounted to the rear surface 144*b* of the body 144. An opening 172*a* in the mounting plate 172 may be dimensioned to define an inlet of the freezer fan 156.

Referring to FIG. 8, the freezer cooling module 130 is positioned within the lower compartment 76 of the liner 72. It is contemplated that the plurality of tabs 143 on the cover 134 of the freezer cooling module 130 (FIG. 7C) and the plurality of recesses (not shown) on the side walls 76*a* of the lower compartment 76 may be positioned and dimensioned to align with each other and engage in a snap-fit fashion. It is contemplated that the plurality of tabs 143 and the plurality of recesses may be used to properly position the freezer cooling module 130 into the lower compartment 76 until fasteners (not shown) more rigidly secure the freezer cooling module 130 to the lower compartment 76. The flange portion 136*b* of the cover 134 is positioned to be spaced from the sloped portion 96 of the lower compartment 76. The lower mounting hole 98 in the lower compartment 76 (FIG. 4B) and the mounting hole 142 in the flange portion 136*b* (FIG. 7A) may be positioned and dimensioned to be in registry with each other so that fasteners (not shown) may extend through the flange portion 136*b* and into the rear wall 76*d* of the lower compartment 76 to secure the freezer cooling module 130 to the lower compartment 76. The flange portion 136*b* and the sloped portion 96 define a portion of a return flow path "B2" that extends from a lower portion of the freezer compartment 120 to the gap 168 below the freezer evaporator 158. The cover 134 and the rear wall 76*d* of the liner 72 define an evaporator chamber 174 that is dimensioned to receive the evaporator 158.

When the freezer cooling module 130 is positioned within the lower compartment 76, the horizontal portion 166*a* of the frame member 166 extends into the gully or channel 94 formed in the liner 72. The gully or channel 94 and the gap 168 together define a portion of a flow path "B1" from the VCZ compartment 200 to the freezer cooling module 130. The flow path "B1" allows air to flow from the gully or channel 94 in the liner 72 to the gap 168 below the freezer evaporator 158. Thus, flow paths "B1" and "B2" allow air to flow into the freezer cooling module 130. The outlet 152 is positioned and dimensioned to at least partially extend into the recess 99 in the rear wall 76*d* of the lower compartment 76. The outlet 152 defines a portion of a flow path "C" for allowing air to exit or be exhausted from the freezer cooling module 130 and into the VCZ compartment 200, as described in detail below. Additionally, the openings 138*a*, 138*b*, 138*c* in the cover 134 also allow air from the air path "A" to exit or be exhausted from the freezer cooling module 130 into the freezer compartment 120.

Although not shown, it is contemplated that one or more gasket elements may be positioned along the rear surface of the freezer cooling module 130 to define seal between the freezer cooling module 130 and the rear wall 76*d* of the lower compartment 76.

VCZ Compartment 200

Figure 9B:
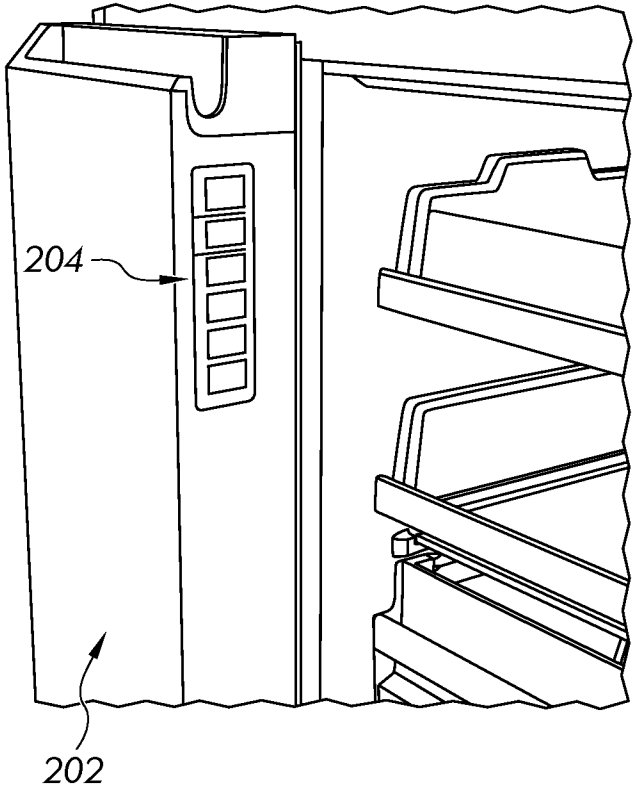
FIG. 9B is a reverse perspective view of a lower portion of the refrigerator of FIG. 1 illustrating a door for the variable climate zone compartment with the freezer door removed to show a user interface according to another embodiment.
Figure 9A:
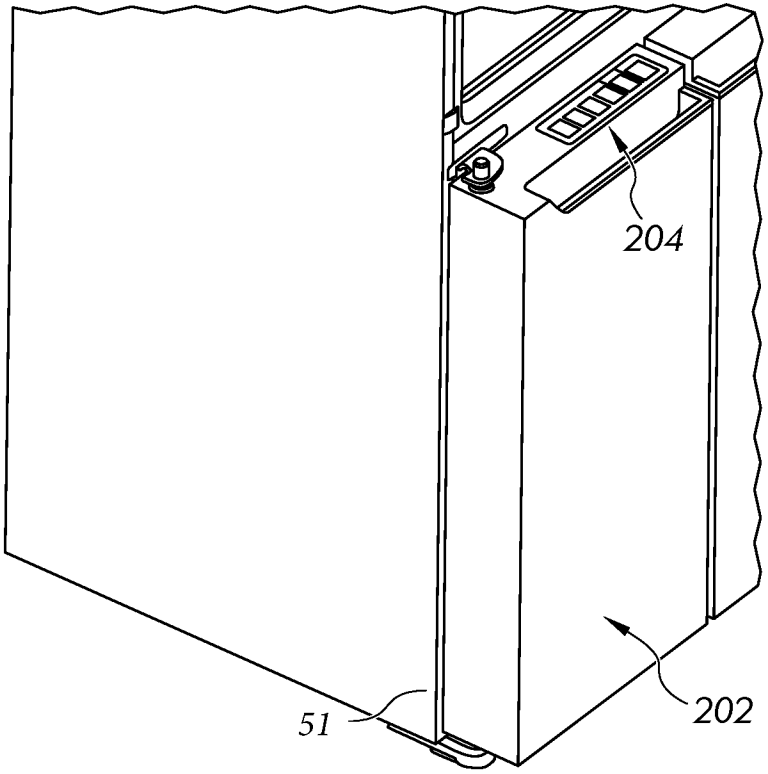
FIG. 9A is a perspective view of a lower portion of the refrigerator of FIG. 1 illustrating a door for the variable climate zone compartment with fresh food compartment doors removed to show a user interface according to one embodiment.

Referring back to FIG. 6, the VCZ compartment 200 is positioned in the lower compartment 76 to the left of the partition 100 (when viewed from the front of the refrigerator 10). The VCZ compartment 200 is configured to operate at different user-selectable temperatures as either a refrigerator (i.e., above-freezing) or a freezer (i.e., below-freezing). In general, the VCZ compartment includes shelves 12 (FIG. 2), bins 14 (FIG. 2) and a temperature control module 220. A door 202 (FIGS. 1, 9A and 9B) is provided for closing the VCZ compartment 200.

A control unit or user interface 204 (FIGS. 9A and 9B) is disposed on the door 202. The user interface 204 is positioned such that it is not visible when both the door 202 of the VCZ compartment 200 and the door assembly 122 of the freezer compartment 120 are in the closed position (see FIG. 1). The user interface 204 is accessible when the door 202 of the VCZ compartment 200 is pivoted open. The user interface 204 is configured to allow a user the ability to selectively operate the VCZ compartment 200 at a user-selectable target variable climate zone temperature between a predetermined temperature below 0 degrees Centigrade and a predetermined temperature above 0 degrees Centigrade including both true fresh food and freezing temperatures, for example, −18° C., −12° C., −2 C, 0° C. and +4° C. It is contemplated that the user interface 204 may be a plurality of push buttons, capacitive touch buttons, a touch display screen, a keyboard or any conventional device for allowing a user to input commands to a control system (not shown) of the refrigerator 10. In the embodiment shown in FIG. 9A, the user interface 204 is on an upper edge of the door 202. In the embodiment shown in FIG. 9B, the user interface 204 is on a side edge of the door 202.

Temperature Control Module 220

Figure 10A:
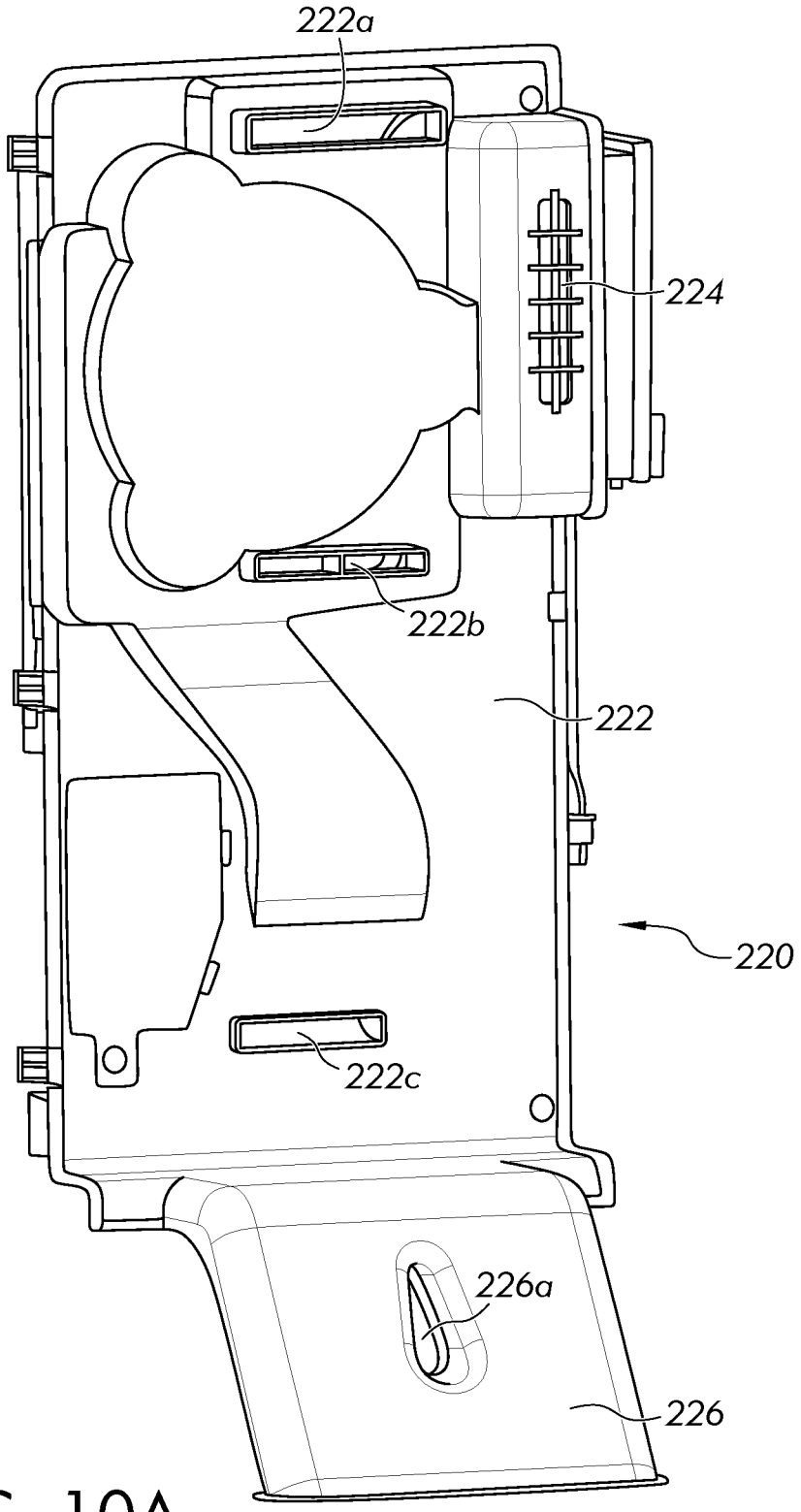
FIG. 10A is a front perspective view of the temperature control module of FIG. 6.
Figure 10B:
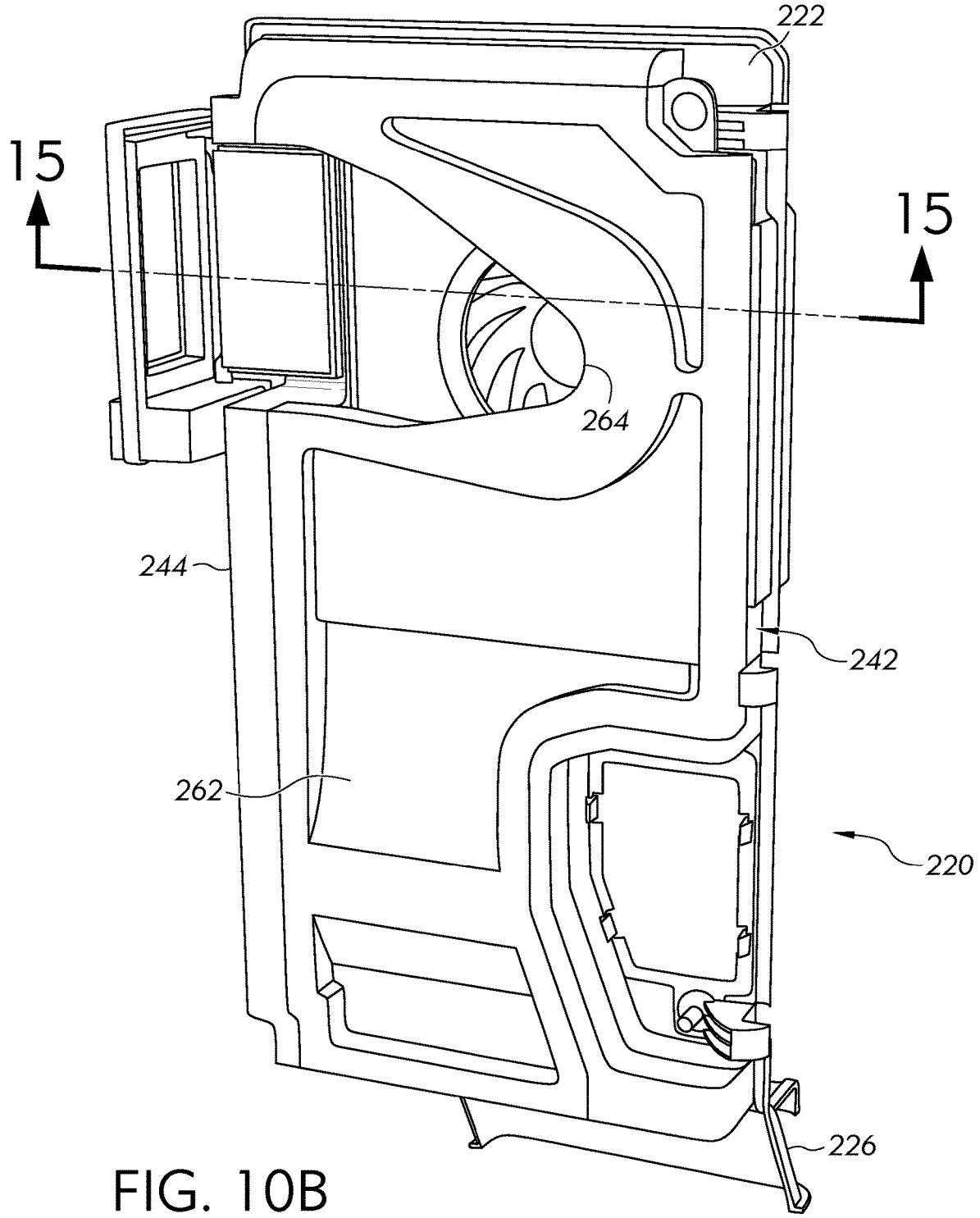
FIG. 10B is a rear perspective view of the temperature control module of FIG. 10A.

Referring to FIG. 6, the temperature control module 220 of the VCZ compartment 200 is shown. The temperature control module 220 is positioned in a rear portion of the VCZ compartment 200. Referring to FIGS. 10A-10B, the temperature control module 220 includes, in general, a vertical partition or cover 222, front and rear body portions 244, 262, a heater 272, a fan 274, and a damper assembly 292. The front body portion 244 is also referred to as "a first heat-insulating element" and the rear body portion 262 is also referred to as "a second heat-insulating element."

Referring to FIG. 10A, the cover 222 includes a plurality of outlets 222*a*, 222*b*, 222*c* for exhausting air from the temperature control module 220 into the VCZ compartment 200. In the embodiment shown, the outlets 222*a*, 222*b*, 222*c* are generally rectangular-in-shape. It is contemplated that the outlets 222*a*, 222*b*, 222*c* may be other shapes, e.g., oval, circular, square, etc. The outlets 222*a*, 222*b*, 222*c* define outlets for allowing air to exit or be exhausted from the temperature control module 220 and into the VCZ compartment 200, as described in detail below. Optionally, in the embodiment shown, the outlets 222*a*, 222*b*, 222*c* include flow guide elements (not shown) for directing the air exiting the temperature control module 220 in a predetermined direction into the VCZ compartment 200. It is contemplated that the cover 222 may be made from plastic.

An inlet 224 extends through the cover 222. In the embodiment shown, the inlet 224 is a grated opening having a plurality of rectangular openings. It is contemplated that the inlet 224 may be a single opening or the grated opening may be defined by an insert that is positioned in or over a single opening. In the embodiment shown. The cover 222 includes a lower (guide) surface or cover element 226. The cover element 226 is an awning-shaped element that extends downwardly from a lower edge of the cover 222. It is contemplated that the cover element 226 may have other shapes and/or sizes. In the embodiment shown, the cover element 226 is integral with the cover 22. It is contemplated that the cover element 226 may be a separate part that is attached to the cover 222. A mounting hole 226*a* extends through the cover element 226 for securing the temperature control module 220 to the liner 72, as described in detail below.

Figure 11:
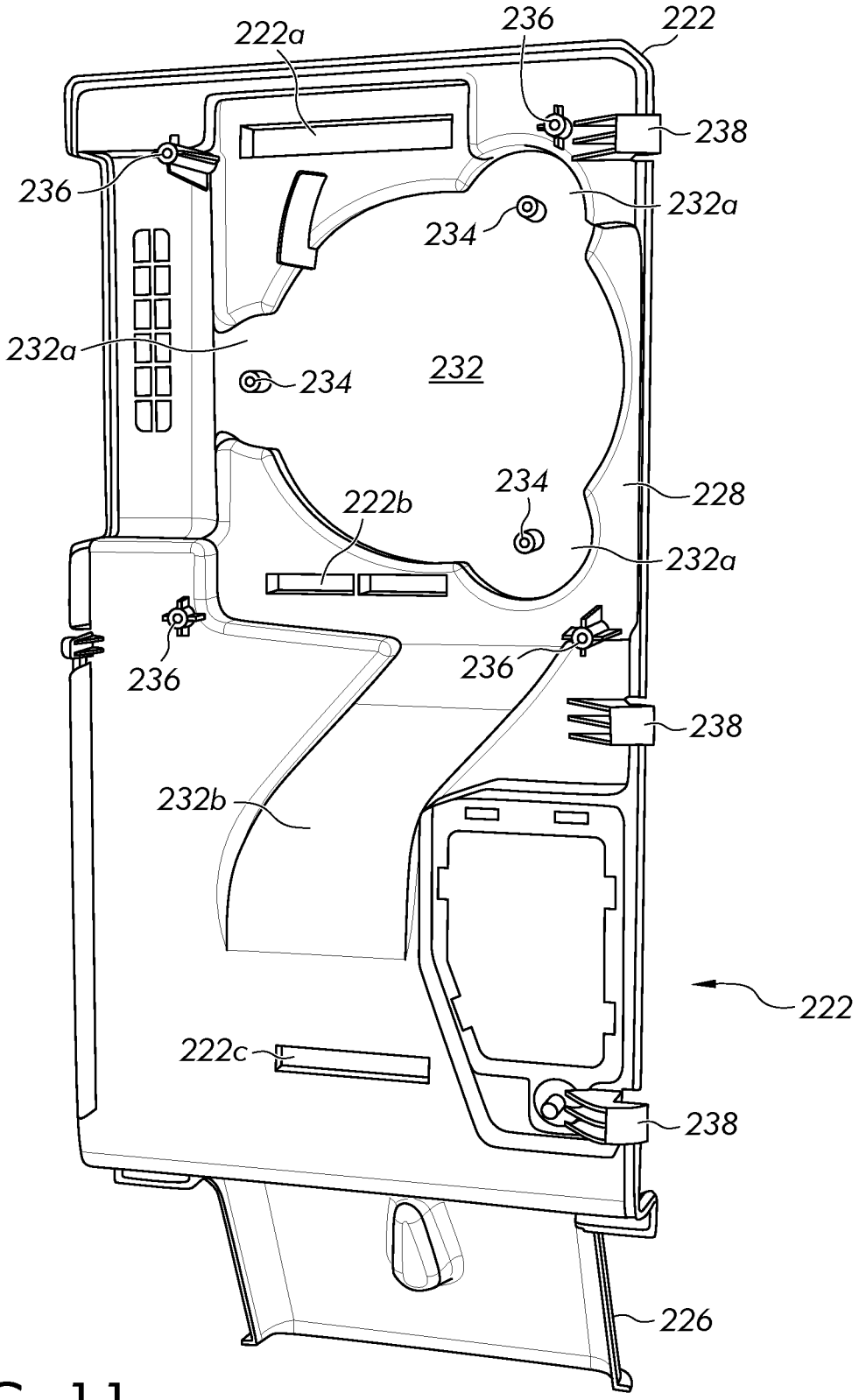
FIG. 11 is a rear perspective view of a cover for the temperature control module of FIG. 10.

Referring to FIG. 11, a rear surface 228 of the cover 222 is shown. A first air passage chamber or recess 232 is formed in the rear surface 228. In the embodiment shown, the recess 232 is generally circular in shape and includes three circular portions 232*a*. A boss 234 is disposed in a center portion of each circular portion 232*a*. The recess 232 is dimensioned as described in detail below. A ramped recess 232*b* extends from the recess 232 toward the outlet 222*c*. The ramped recess 232*b* is dimensioned as described in detail below. Four mounting bosses 236 are disposed around the recess 232. Each boss 236 is dimensioned to receive a fastener (not shown), as described in detail below. Three tabs 238 are positioned along one edge of the cover 222. The tabs 238 are positioned and dimensioned as described in detail below. It is contemplated that the cover 222 may be made of a plastic material, such as, but not limited to polypropylene.

Figure 12B:
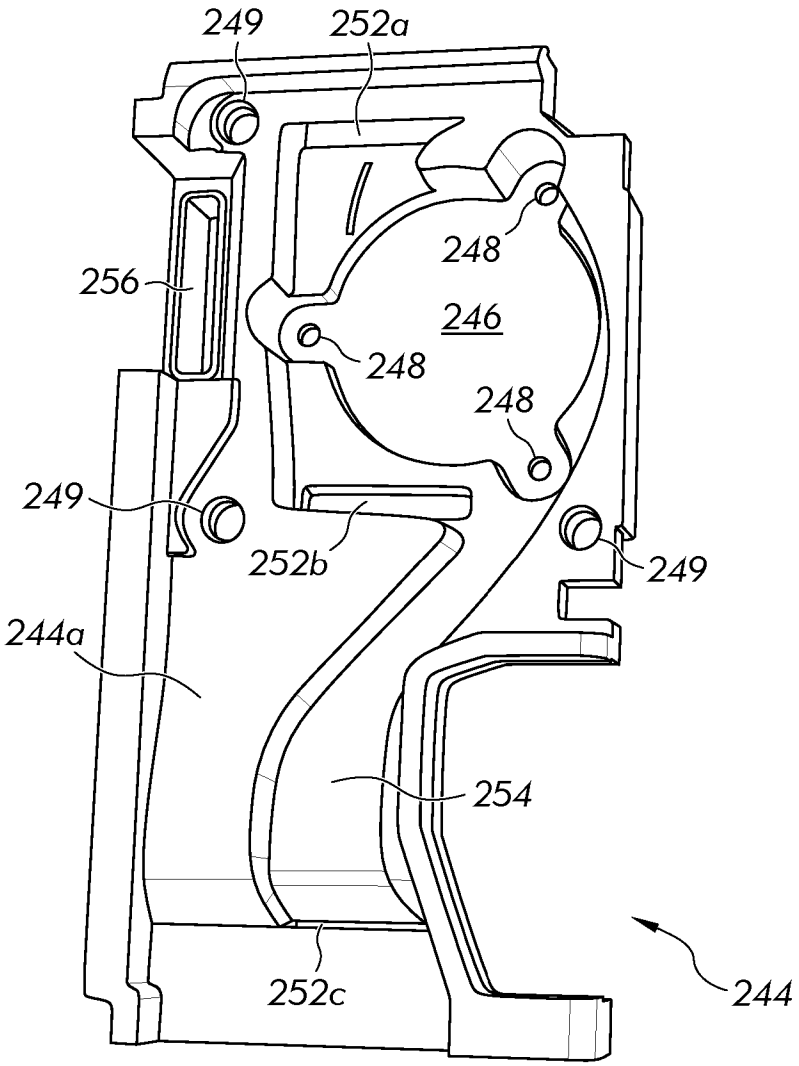
FIG. 12B is a rear perspective view of a front body portion of the temperature control module of FIG. 10A.
Figure 12A:
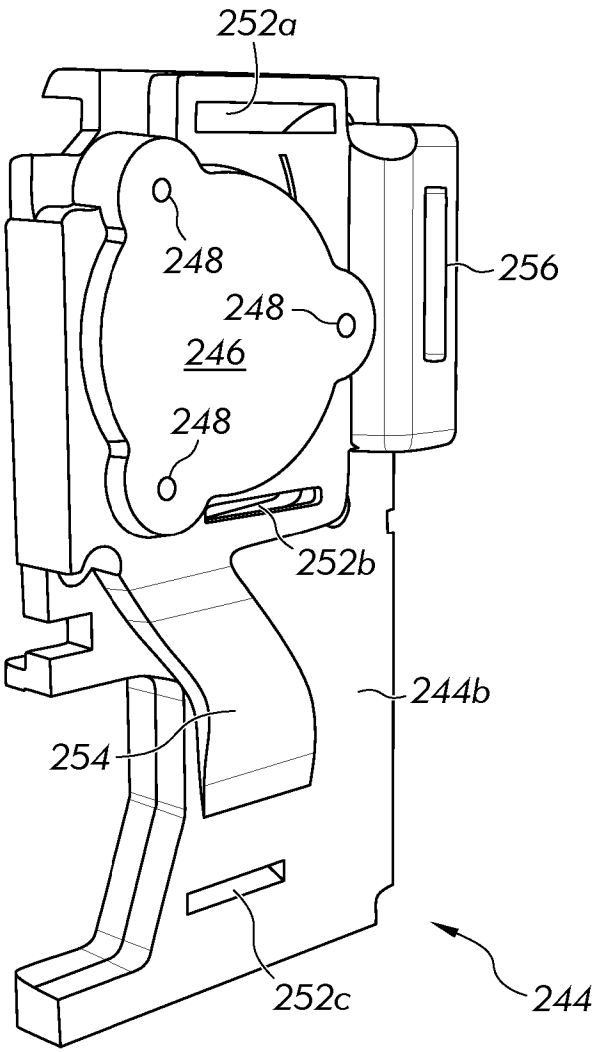
FIG. 12A is a front perspective view of a front body portion of the temperature control module of FIG. 10A.

Referring to FIG. 10B, the body 242 includes a front body portion 244 (FIGS. 12A and 12B) and a rear body portion 262. Referring now to FIGS. 12A and 12B, the front body portion 244 is contoured to engage the rear surface 228 of the cover 222. A contoured recess 246 extends into a rear surface 244*a* of the front body portion 244 and protrudes from a front surface 244*b* of the front body portion 244. The recess 246 is dimensioned and positioned to be received into the recess 232 of the cover 222. A hole 248 extends through each circular portion of the recess 246 and is dimensioned and positioned align with a corresponding bosses 234 in the cover 222. The recess 246 communicates with two outlets 252*a*, 252*b* that extend through the front body portion 244 The two outlets 252*a*, 252*b* are dimensioned and positioned to align with outlets 222*a*, 222*b* of the cover 222 when the front body portion 244 mates with the cover 222.

The front body portion 244 also includes a ramped portion 254 that extends from the recess 246. The ramped portion 254 extends to an outlet 252*c*. The outlet 252*c* is dimensioned and positioned to align with the outlet 222*c* of the cover 222. The front body portion 244 also includes an opening 256 that aligns with the inlet 224 in the cover 222.

Referring to FIG. 10B, the rear body portion 262 is contoured to mate with the rear surface 244*a* of the front body portion 244. The rear body portion 262 and the front body portion 244 are contoured to define an air path "D" (FIGS. 16, 17, 18) therebetween, as described in detail below. A slot 264 is formed in one side edge of the rear body portion 262. The slot 264 is dimensioned and positioned as described in detail below. It is contemplated that at least one of the front body portion 244 and the rear body portion 262 may be made of plastic material, such as, but not limited to expanded polystyrene (EPS).

Figure 13B:
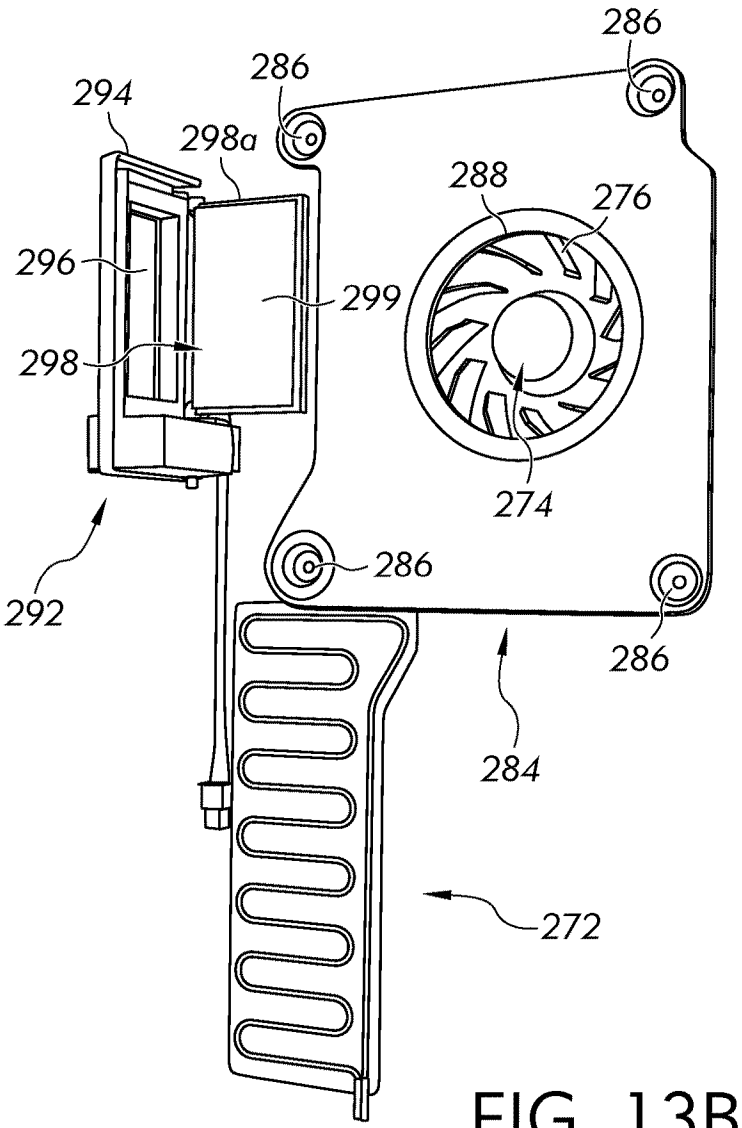
FIG. 13B is a rear perspective view of a heater, a fan and a damper door assembly for the temperature control module of FIG. 10A.
Figure 13A:
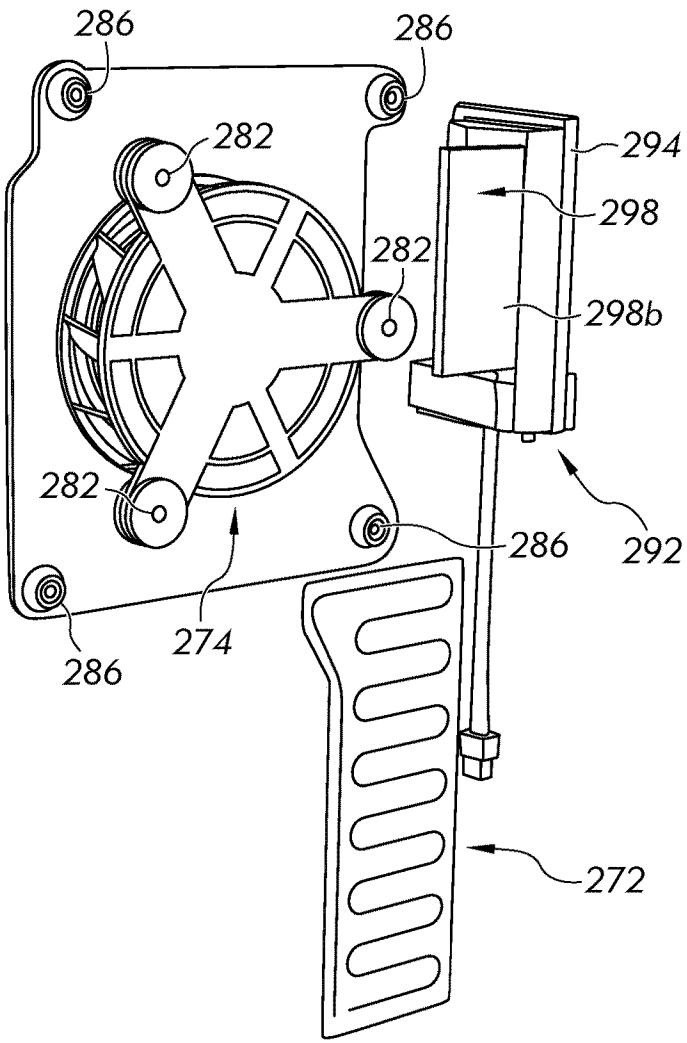
FIG. 13A is a front perspective view of a heater, a fan and a damper door assembly for the temperature control module of FIG. 10A.

Referring to FIGS. 13A and 13B, the heater 272, the fan 274 and the damper assembly 292 are illustrated removed from the temperature control module 220. The heater 272, the fan 274 and the damper assembly 292 are shown in their relative position when installed within the temperature control module 220. The fan 274 and the damper assembly 292 are positioned between the front body portion 244 and the rear body portion 262 and the heater 272 is disposed on the front surface 244*b* of the front body portion 244. The heater 272 is shown as an elongated electric coil heater. It is contemplated that the heater 272 may be other types of conventional heating elements, such as, but not limited to, a strip electric heater, a ceramic heater, a flexible heating element, a thermoelectric heating element, or even a portion of the condenser tubing, etc. It is contemplated that a thermal tape (not shown) may optionally be used for securing the heater 272 to the front body portion 244 during a manufacturing process, although the heater 272 could be mounted by way of mechanical fasteners or the like. As described above, the heater 272 is disposed on the front surface 244*b* of the front body portion 244. It is also contemplated that the heater 272 may be embedded within the front body portion 244.

In the embodiment shown, the temperature control module 220 is shown as including the cover 222, the front body portion 244 and the heater 272 captured therebetween. It is contemplated that the cover 22 and the front body portion 244 may be formed as a single monolithic body (e.g., a single molded component) that is overmolded around the heater 272. Alternatively, the heater 272 may be inserted into a slot formed, e.g., molded or machined into the single monolithic body.

Figure 15:
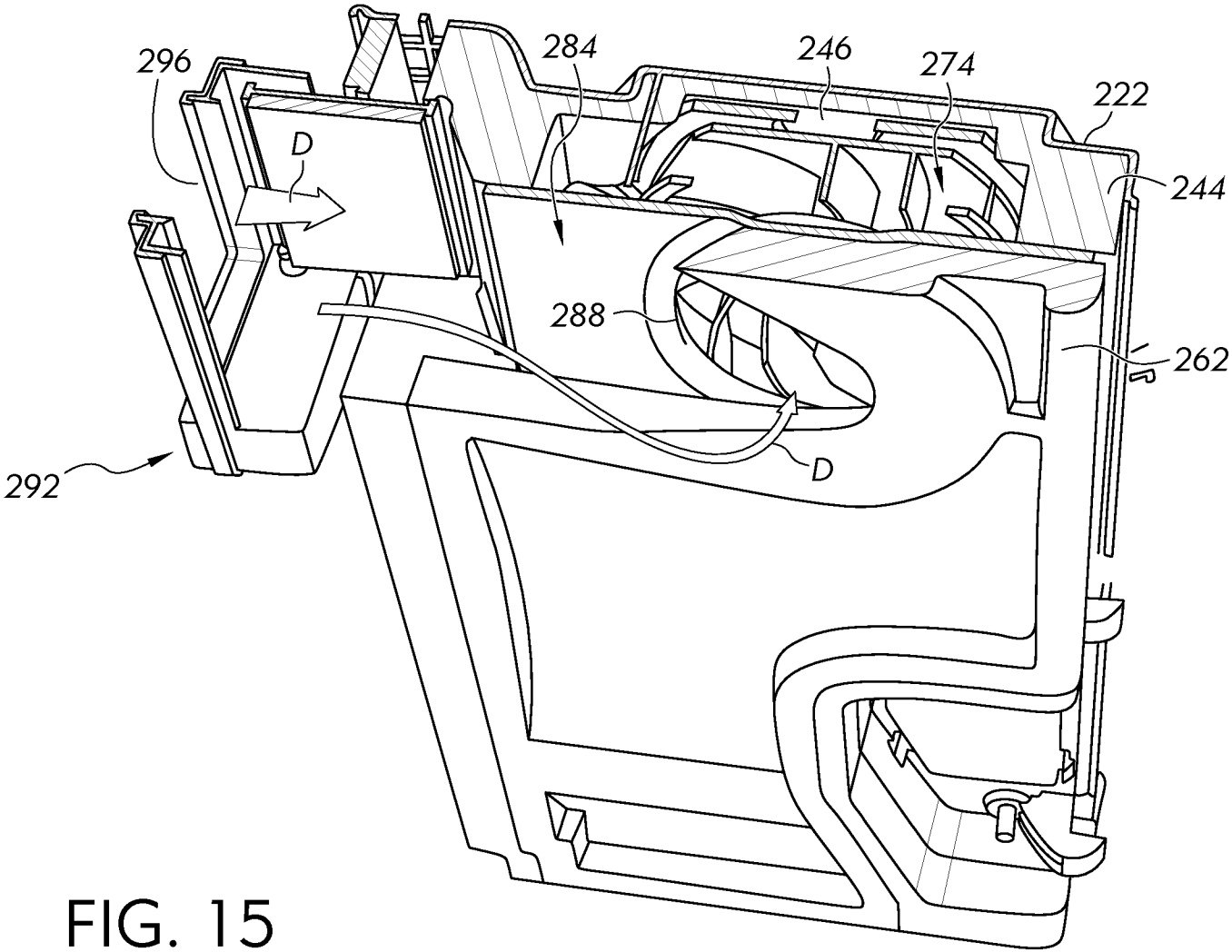
FIG. 15 is a section view taken along lines 15-15 of FIG. 6 illustrating certain air flow paths.

Referring to FIG. 15, the fan 274 is positioned within the recess 246 of the front body portion 244. As shown in FIG. 13A, 13B, the fan 274 is a radial fan and includes a plurality of vanes 276 for drawing air into the fan 274 and exhausting the air radially away from an outer periphery of the fan 274. The fan 274 is shown as a centrifugal fan that discharges air outwards along its periphery, although other types of fans (i.e., axial fans, etc.) are contemplated. The fan 274 includes three mounts 282 for securing the fan 274 to the bosses 234 of the cover 222. In particular the bosses 234 extend through corresponding holes 248 in the front body portion 244. Fasteners (not shown) are provided for securing the fan 274 to the cover 222 thereby securing the front body portion 244 therebetween.

A fan shroud or mounting plate 284 is provided for attachment to the rear surface 244*a* of the front body portion 244. The mounting plate 284 includes four mounting holes 286 that are dimensioned and positioned to align with the four bosses 236 of the cover 222. In particular, the bosses 236 extend through corresponding holes 249 (FIGS. 12A, 12B) in the front body portion 244 to allow fasteners (not shown) to thread through the mounting plate 284, through the front body portion 244 and to the bosses 236 of the cover 222. An inlet or opening 288 extends through the mounting plate 284 and is aligned with a center of the fan 274 when the fan 274 and the mounting plate 284 are secured to the front body portion 244.

The damper assembly 292 includes a frame 294 and a damper door 298. The frame 294 includes an opening 296 extending through the frame 294. The damper door 298 is attached to the frame 294 to pivot relative to the opening 296. The damper door 298 has a shape that closely matches the shape of the opening 296 for closing the opening.

The damper door 298 may include a seal element 299 on a first side 298*a* of the damper door 298. Preferably, the seal element 299 may be made of an elastic element, e.g., rubber or foam, although a rigid plastic material could also be used. It is contemplated that the seal element 299 may be attached to the first side 298*a* of the damper door 298 using a fastening means, such as, but not limited to adhesives, fasteners, etc. In the embodiment shown, the seal element 299 is a single element that is attached to the first side 298*a* of the damper door 298. It is contemplated that the seal element 299 may be formed by encasing or surrounding the entire damper door 298 such that the seal element covers the first side 298*a* and a second side 298*b* of the damper door 298.

A motor (not shown) may be provided for moving the damper door 298. The damper door 298 may be moveable between a first or closed position (not shown) and a second or open position (FIGS. 13A and 13B). When in the closed position the seal element 299 engages the frame 294 for obstructing the flow of air through the opening 296. In the embodiment shown, the seal element 299 is shown as part of the damper door 298. It is also contemplated that the seal element 299 may be part of the frame 294. When in the open position, the damper door 298 is positioned as described in detail below.

It is contemplated that the motor may pivot the damper door 298 to a plurality of positions between, and including, the open position and the closed position for controlling and adjusting the flow of air to the VCZ compartment 200. It is also contemplated that a damper door heater element (not shown) may be disposed in/on the frame 294 and/or the damper door 298 for heating the frame 294 and/or the damper door 298. The heat applied to the frame 294 and/or the damper door 298 by the damper door heater element may be sufficient to prevent the damper door 298 from freezing to the frame 294 and/or the formation of frost that prevents the damper door 298 from fully closing.

Figure 14:
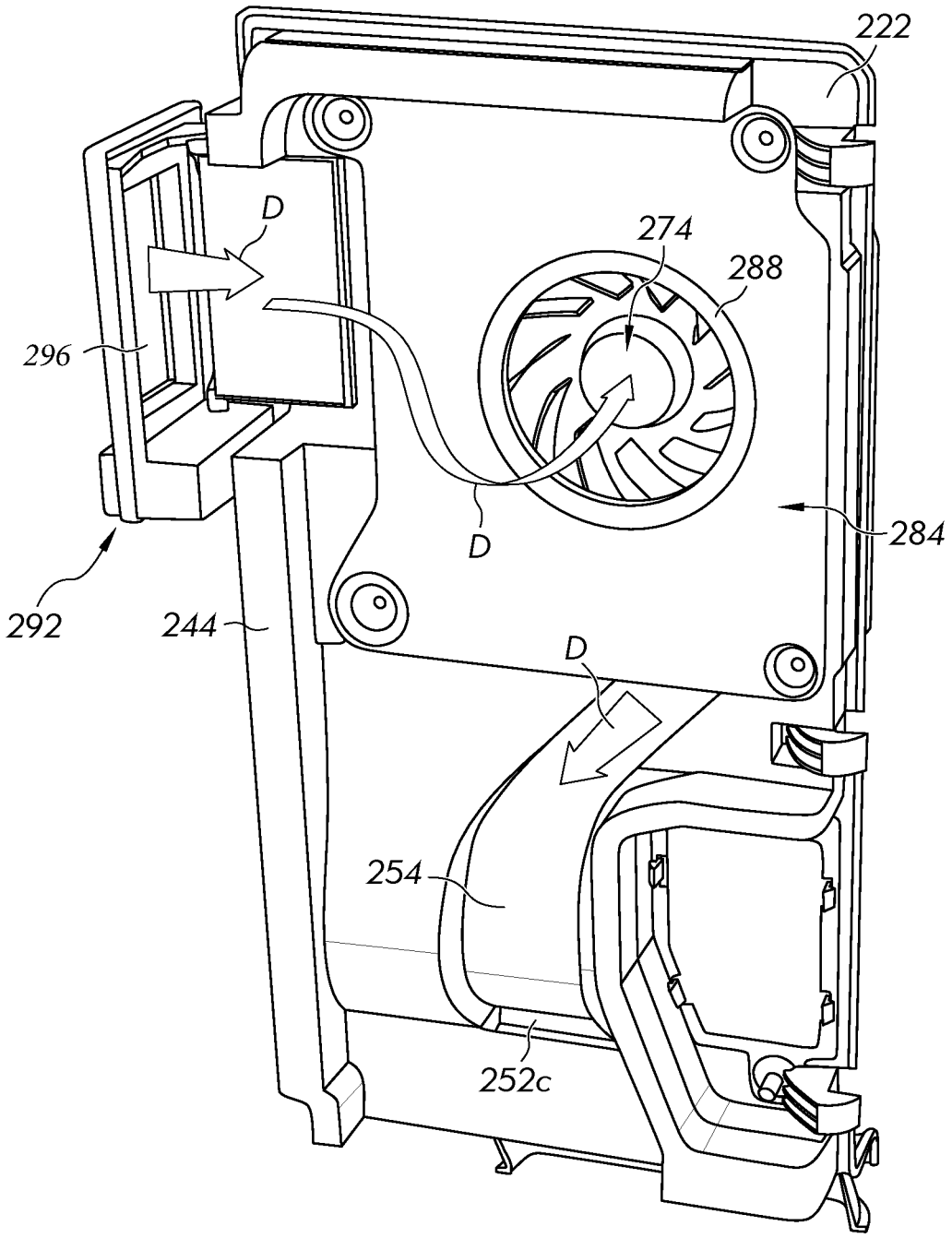
FIG. 14 is a rear perspective of the temperature control module of FIG. 10A with a rear body portion removed.

In one embodiment, the temperature control module 220 is assembled by first placing the heater 272 on the front surface 244*b* of the front body portion 244. Referring to FIG. 14, the front surface 244*b* of the front body portion 244 is then positioned adjacent the rear surface 228 of the cover 222 to secure the heater 272 between the cover 222 and the front body portion 244. As described in detail above, the bosses 234, 236 (FIG. 11) of the cover 222 align with the holes 248, 249 (FIG. 12A, 12B) of the front body portion 244 such that the bosses 234, 236 extend through the corresponding holes 248 249. The fan 274 and the mounting plate 284 are then fastened to the corresponding bosses 234, 236 of the cover 222 to secure the fan 274 and the mounting plate 284 to the front body portion 244 and the cover 222.

For clarity and discussion purposes, the rear body portion 262 is not shown in FIG. 14. The fan 274 and mounting plate 284 are illustrated attached to the front body portion 244. The rear surface 244*a* of the front body portion 244 is contoured to define an air flow path "D" from the fan 274. The damper assembly 292 is shown in the open position such that air is permitted to flow through the opening 296 and to the inlet of the fan 274 along an air flow path "D."

Referring to FIG. 15, the rear body portion 262 is illustrated attached to the front body portion 244 to enclose the air flow path "D". FIG. 15 also illustrates the flow of air through the temperature control module 220 along the air flow path "D" through the damper assembly 292.

Figure 16:
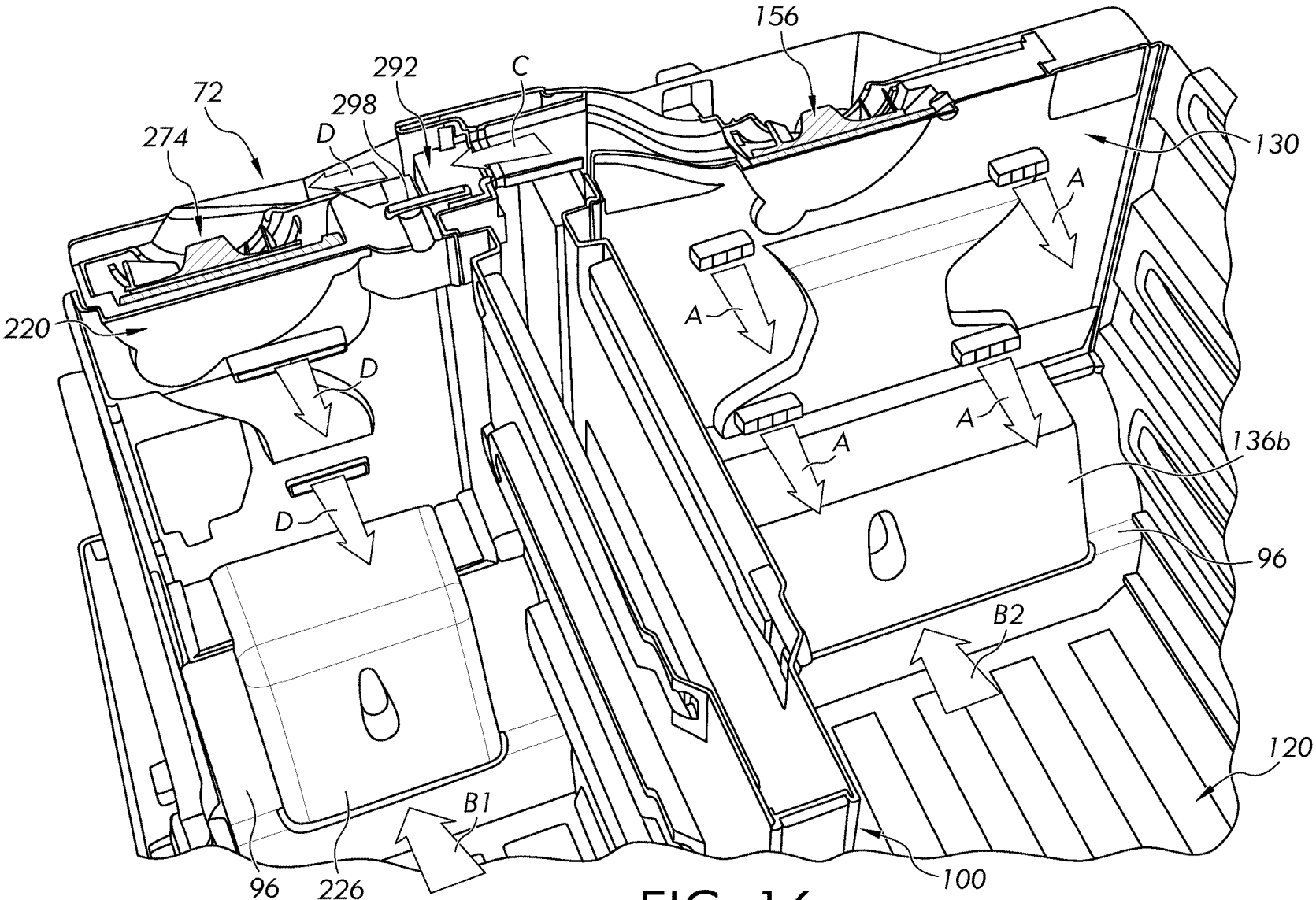
FIG. 16 is a section view taken along lines 15-15 of FIG. 6 illustrating other air flow paths.
Figure 17:
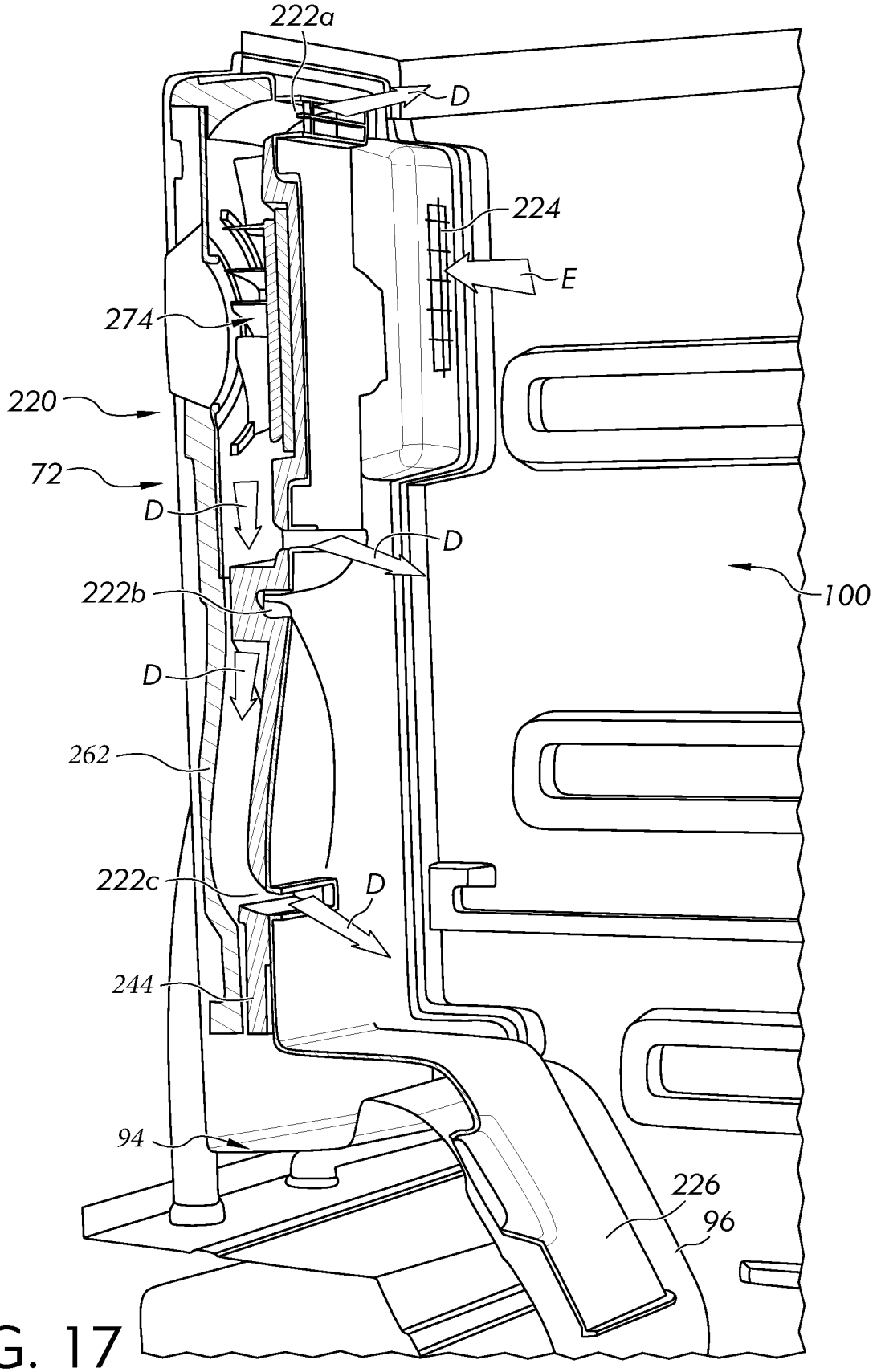
FIG. 17 is a section view taken along lines 15-15 of FIG. 6 illustrating still other air flow paths.

Referring to FIGS. 16 and 17, the temperature control module 220 is illustrated positioned in the lower compartment 76 adjacent the partition 100. Prior to positioning the temperature control module 220 into the lower compartment 76, the damper assembly 292 is positioned in the opening 102 of the partition 100. It is contemplated that the seat 106 formed in the opening 102 may be dimensioned such that the frame 294 of the damper assembly 292 abuts the seat 106. The temperature control module 220 is positioned so that the rear body portion 262 abuts the rear wall 76*d* of the liner 72. The liner 72 then bounds the open side of the air flow path "D" (illustrated in FIGS. 15 and 16).

Referring back to FIG. 6, the temperature control module 220 of the VCZ compartment 200 is positioned in the lower compartment 76 to the left of the partition 100. It is contemplated that the plurality of tabs 238 (FIG. 11) on the cover 22 of the temperature control module 220 are positioned and dimensioned to align with mating recesses 86 (FIG. 4B) in the liner 72 in a snap-fit fashion.

Referring back to FIGS. 6, 16 and 17, the temperature control module 220 is positioned in the lower compartment 76 above the gully or channel 94 in the back of the lower compartment 76. The gully or channel 94 and the lower portion of the temperature control module 220 define an air flow path "B1" (FIGS. 8 and 16) from the VCZ compartment 200, through the partition 100 and to the freezer evaporator 158 in the freezer compartment 120. The gully or channel 94 is also referred to as a "second air passage chamber."

Operation

The VCZ compartment 200 will now be described with respect to the operation of the same. As described above, the freezer cooling module 130 is configured to supply cold air to the both the freezer compartment 120 and the VCZ compartment 200, hereinafter referred to as a Dual Cooling Mode of the refrigerator 10. In the Dual Cooling Mode, the control unit (not shown) of the refrigerator 10 causes the damper door 298 to be in the second or open position (FIG. 16). The controller also causes a refrigerant to be circulated through the freezer evaporator 158 and energizes the freezer fan 156. It is contemplated that the fan 274 may also be energized to improve the air flow supply to the VCZ compartment 200.

Referring initially to FIG. 16, the control unit causes the freezer fan 156 to rotate such that inlet air is drawn along the air flow path "B1." In particular, air in the freezer compartment 120 is drawn through the space between the flange portion 136*b* and the sloped portion 96 of the bottom wall 76*c* of the lower compartment 76. As illustrated in FIG. 8, the air is drawn into the gap 168 below the freezer evaporator 158. Referring back to FIG. 16, the freezer fan 156 also causes inlet air to be drawn from the VCZ compartment 200 along the air flow path "B1," then through the gully or channel 94 below the temperature control module 220 along the flow path "B1," as shown in FIG. 8. This air is drawn under the partition 100 to the freezer evaporator 158.

Referring back to FIG. 8, the air from the flow path "B1" is drawn into the gap 168 below the freezer evaporator 158 to mix with the air drawn from the freezer compartment 120 along flow path "B2". This mixed air is then drawn over the freezer evaporator 158 which removes heat from the air. The freezer fan 156 then forces the air back into the freezer compartment 120 along flow path "A." A portion of the air exits the freezer cooling module 130 along flow path "C."

Referring back to FIG. 16, the air flow along flow path "C" passes through the damper assembly 292 and flows to the fan 274 in the temperature control module 220 along flow path "D" (see FIG. 15). As noted above, the damper door 298 is in the open position. In this position the damper door 298 engages the front body portion 244 and obstructs the opening 288 while allowing air to flow through the opening 296 of the damper assembly 292. The air then enters the temperature control module 220 wherein the fan 274 causes the air to be conveyed along the air flow path "D" and out of the outlets 222*a*, 222*b*, 222*c* into the VCZ compartment 200.

The air in the VCZ compartment 200 is returned back to the freezer evaporator 158 along the flow path "B1," as described in detail above. The air continues to be circulated as described above until each of the freezer compartment 120 and VCZ compartment 200 are cooled to their respective desired temperatures.

Referring to FIG. 17, once a desired cool temperature is reached in the VCZ compartment 200 (i.e., as preselected via the user interface 204), the control unit may initiate a mode wherein the air in the VCZ compartment 200 and the air in the freezer compartment 120 are independently circulated. To isolate the VCZ compartment 200 and the freezer compartment 120, the control unit may cause the damper door 298 to move to the closed position (not shown) such that cold air from the freezer cooling module 130 is no longer supplied to the VCZ compartment 200. The fan 274 then causes the air to be drawn into the temperature control module 220 from the VCZ compartment 200 along the flow path "E" and exit the temperature control module 220 through the outlets 222*a*, 222*b*, 222*c* of the cover 222 along flow path "D." In this respect, the fan 274 causes the air in the VCZ compartment 200 to circulate in a closed loop circulation path between the VCZ compartment 200 and the temperature control module 220 to maintain the preselected temperature. It is also contemplated that the fan 274 may be de-energized such that the air does not circulate within the VCZ compartment 200. Optionally, if the VCZ compartment 200 warms slightly over time, the control unit may cause the damper door 298 to open partially or even completely to intake additional cold air from the freezer to achieve the preselected temperature again. It is contemplated that the damper door 298 can be selectively opened and closed as necessary to maintain the temperature of the VCZ compartment 200 over time.

The control unit may also continue to energize the freezer fan 156 and convey the refrigerant through the freezer evaporator 158 to maintain the freezer compartment 120 at a lower temperature than the VCZ compartment 200. The operation of the freezer fan 156 causes the air in the freezer compartment 120 to circulate in a closed loop path between the freezer compartment 120 and the freezer evaporator 158.

During another mode of operation, hereinafter referred to as the Heat VCZ Compartment Mode, the control unit may cause both the heater 272 and the fan 274 of the temperature control module 220 to be energized. When energized, the heater 272 causes the temperature of the front body portion 244 to increase. This increase in temperature, in turn, causes an increase in the temperature of the air within the front body portion 244 of the temperature control module 220. This heated air is then conveyed into VCZ compartment 200 by the fan 274. The heater 272, and optionally the fan 274 may remain energized until the temperature in the VCZ compartment 200 is warmed to the desired temperature. Optionally, the damper door 298 may be in the closed position to obstruct cold air from the freezer compartment 120. If desired, the temperature in the VCZ compartment 200 may be reduced by implementing the Dual Cooling Mode, as described in detail above. It is contemplated that the control unit may be programmed to alternate between the Dual Cooling Mode and the Heat VCZ Compartment Mode to maintain the VCZ compartment at the desired temperature. It is also contemplated that the Heat VCZ Compartment Mode may find particular application in raising the temperature of the VCZ compartment 200 quickly, if desired.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

The invention claimed is:

1. A refrigeration appliance comprising:

a compartment for storing food items in a refrigerated environment;

a partition dividing said compartment into a first compartment and a second compartment, said first compartment disposed horizontally adjacent said second compartment, said first compartment having a user-selectable target freezer temperature, said second compartment having a user-selectable target variable climate zone temperature between a predetermined temperature below 0 degrees Centigrade and a predetermined temperature above 0 degrees Centigrade;

an evaporator disposed in the first compartment;

an evaporator fan disposed in the first compartment for conveying cooling air from the evaporator to the first compartment and the second compartment; and a temperature control module positioned in the second compartment, the temperature control module comprising:

a body positioned in the second compartment, the body having:

a front surface facing an open end of the second compartment, a rear surface facing a rear wall of the second compartment, a side inlet opening, at least one outlet opening on the front surface, and an air passage formed in the body between the front surface and rear surface, the air passage extending between the side inlet opening of the body to the at least one outlet opening on the front surface of the body, and a heater assembly disposed proximate to the air passage, wherein air in the air passage is heated by the heater assembly when the heater assembly is energized.

2. The refrigeration appliance according to claim 1, wherein the heater assembly includes an electrical coil.

3. The refrigeration appliance according to claim 1, wherein the heater assembly is overmolded into the body.

4. The refrigeration appliance according to claim 1, wherein the body includes a front portion and a rear portion and at least a portion of the air passage is defined between the rear portion and the front portion.

5. The refrigeration appliance according to claim 4, wherein the at least a portion of the air passage is defined by a recess formed in at least one of the front portion and the rear portion.

6. The refrigeration appliance according to claim 4, wherein the heater assembly is embedded within at least one of the front portion and the rear portion.

7. The refrigeration appliance according to claim 1, wherein the air passage includes a second inlet opening extending through the front surface of the body.

8. The refrigeration appliance according to claim 1, further comprising a circulation fan positioned in the air passage for conveying air therealong.

9. The refrigeration appliance according to claim 1, wherein the air passage defines a closed loop circulation path with the second compartment.

10. The refrigeration appliance according to claim 1, further comprising:

a fresh food compartment disposed above the compartment, the fresh food compartment for storing food items in a refrigerated environment having a target temperature above zero degrees Centigrade.

11. A refrigeration appliance comprising:

a compartment for storing food items in a refrigerated environment;

a partition dividing said compartment into a first compartment and a second compartment, said first compartment disposed horizontally adjacent said second compartment, said first compartment having a user-selectable target freezer temperature, said second compartment having a user-selectable target variable climate zone temperature between a predetermined temperature below 0 degrees Centigrade and a predetermined temperature above 0 degrees Centigrade, the partition defining a through passage between the first compartment and the second compartment;

an evaporator disposed in the first compartment;

an evaporator fan disposed in the first compartment for conveying cooling air from the evaporator to the first compartment and the second compartment; and a temperature control module positioned in the second compartment, the temperature control module comprising:

a body having a front surface and a rear surface, the rear surface facing a rear wall of the second compartment and the front surface facing an open end of the second compartment, an air passage formed in the body extending between a side inlet opening of the body and at least one outlet opening on the front surface of the body, the side inlet opening of the air passage aligned with the through passage in the partition between the first compartment and the second compartment, a second inlet opening extending through the front surface of the body to the air passage, and a damper assembly positioned proximate the air passage, the damper assembly comprising:

a frame assembly defining a damper air passage through the damper assembly fluidly communicating with the air passage formed in the partition, and a door rotatably attached to the frame assembly, the door moveable between a first position and a second position, wherein when the door is in the first position the door fluidly isolates the through passage in the partition from the first compartment while allowing the second inlet opening in the body to fluidly communicate with the air passage in the body, and when the door is in the second position the door fluidly isolates the second inlet opening in the body from the air passage in the body while allowing the through passage in the partition to fluidly communicate with the first compartment.

12. The refrigeration appliance according to claim 11, wherein the air passage forms a closed loop circulation path within the second compartment when the door is in the first position.

13. The refrigeration appliance according to claim 11, wherein the air passage directs cooled air into the second compartment from the evaporator when the door is in the second position.

14. The refrigeration appliance according to claim 11, wherein the air passage is a single conduit extending between the first compartment and the second compartment.

15. The refrigeration appliance of claim 11, wherein the partition is not part of a uniform expanding foam material applied to a space between a liner and a metal shell of the refrigeration appliance.

16. The refrigeration appliance according to claim 11, further comprising:

a liner defining the compartment for storing food items in a refrigerated environment, a rear wall of the liner contoured to define a first horizontal recess therein; and the partition including:

a protrusion extending from a rear edge of the partition, the protrusion disposed in the first horizontal recess in the liner when the partition is positioned in the compartment, an opening extending through the protrusion between opposite side surfaces of the partition, the opening aligned with the first horizontal recess in the liner, and the side inlet opening of the body fluidly communicating with the first horizontal recess in the liner and the opening extending through the partition, wherein the evaporator fan disposed in the first compartment conveys cooling air from the evaporator through the opening extending through the partition, through the side inlet opening in the body, through the air passage in the body, through the at least one outlet opening in the body and exhausts the cooling air into the second compartment.

17. The refrigeration appliance of claim 16, wherein the liner is contoured to define a second horizontal recess fluidly connecting the first compartment and the second compartment, wherein air drawn by the evaporator fan in the first compartment is drawn from the second compartment through the second horizontal recess.

18. A refrigeration appliance comprising:

a compartment for storing food items in a refrigerated environment;

a vertical partition dividing said compartment into a first compartment and a second compartment, said first compartment disposed horizontally adjacent said second compartment, said first compartment having a user-selectable target freezer temperature, said second compartment having a user-selectable target variable climate zone temperature between a predetermined temperature below 0 degrees Centigrade and a predetermined temperature above 0 degrees Centigrade, the vertical partition defining a through passage between the first compartment and the second compartment; and a temperature control module positioned in the second compartment, the temperature control module comprising:

a body positioned in the second compartment, the body having:

a front surface facing an open end of the second compartment, a rear surface facing a rear wall of the second compartment, at least one outlet opening on the front surface of the body, a side inlet opening aligned with the through passage in the vertical partition between the first compartment and the second compartment, an air passage formed in the body between the front surface and rear surface, the air passage extending between the side inlet opening of the body and the at least one outlet opening on the front surface of the body, and a second inlet opening extending through the front surface of the body to the air passage, and a damper assembly positioned proximate the air passage, the damper assembly comprising a door moveable between a first position and a second position, wherein when the door is in the first position the door fluidly isolates the through passage in the vertical partition from the first compartment while allowing the second inlet opening in the body to fluidly communicate with the air passage in the body.

19. The refrigeration appliance of claim 18, wherein when the door is in the second position the door fluidly isolates the second inlet opening in the body from the air passage in the body while allowing the through passage in the vertical partition to fluidly communicate with the first compartment.

20. The refrigeration appliance of claim 18, further comprising:

a heater assembly disposed proximate to the air passage, wherein air in the air passage is heated by the heater assembly when the heater assembly is energized.

* * * * *